US008997803B2

(12) United States Patent
Fallon et al.

(10) Patent No.: US 8,997,803 B2
(45) Date of Patent: Apr. 7, 2015

(54) DISPENSING SYSTEM AND METHOD OF CONTROLLING THE SYSTEM

(75) Inventors: Barry Fallon, Birmingham (GB); Paul Hanniffy, Birmingham (GB)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 745 days.

(21) Appl. No.: 13/030,912

(22) Filed: Feb. 18, 2011

(65) Prior Publication Data

US 2011/0240170 A1 Oct. 6, 2011

Related U.S. Application Data

(60) Provisional application No. 61/308,753, filed on Feb. 26, 2010.

(51) Int. Cl.

| | |
|---|---|
| ***B65B 1/04*** | (2006.01) |
| ***B67D 1/00*** | (2006.01) |
| ***B67D 1/08*** | (2006.01) |
| ***B67D 1/12*** | (2006.01) |

(52) U.S. Cl.

CPC ..... *B67D 1/0003* (2013.01); *B67D 1/0007* (2013.01); *B67D 1/0888* (2013.01); *B67D 1/0894* (2013.01); *B67D 1/1236* (2013.01); *B67D 1/1272* (2013.01)

(58) Field of Classification Search

CPC .. B67D 1/0003; B67D 1/0007; B67D 1/0888; B67D 1/0894; B67D 1/1236; B67D 1/1272

USPC ..... 141/113, 198, 350–356

See application file for complete search history.

(56) References Cited

U.S. PATENT DOCUMENTS

| | | | | |
|---|---|---|---|---|
| 3,592,244 | A * | 7/1971 | Chamberlin | 141/14 |
| RE32,142 | E * | 5/1986 | Meyers | 141/4 |
| 6,397,909 | B1 | 6/2002 | Nelson | 141/356 |
| 6,883,564 | B2 * | 4/2005 | Risch et al. | 141/113 |
| 7,264,026 | B2 * | 9/2007 | Gruber et al. | 141/113 |
| 7,506,663 | B2 | 3/2009 | Thomas et al. | 137/529 |
| 7,673,661 | B2 * | 3/2010 | Chase et al. | 141/360 |
| 8,151,838 | B2 * | 4/2012 | Seaborne et al. | 141/350 |
| 2004/0064989 | A1 | 4/2004 | Nottage et al. | 40/542 |
| 2005/0104035 | A1 | 5/2005 | Eaddy et al. | 252/299.01 |
| 2008/0169048 | A1 | 7/2008 | Windmiller | 141/113 |
| 2008/0264092 | A1 | 10/2008 | Chase et al. | 62/389 |
| 2009/0250491 | A1 | 10/2009 | Erman et al. | 222/135 |
| 2010/0043911 | A1 | 2/2010 | Russell | 141/1 |

FOREIGN PATENT DOCUMENTS

| | | | |
|---|---|---|---|
| GB | 2 137 181 | A | 10/1984 |
| JP | 08011991 | | 1/1996 |
| JP | 2003141629 | | 5/2003 |
| WO | WO 2005/058745 | A2 | 6/2005 |
| WO | WO 2006/055866 | A1 | 5/2006 |
| WO | WO 2007/102139 | A1 | 9/2007 |
| WO | 2007141719 | A1 | 12/2007 |
| WO | WO 2007/141719 | A1 | 12/2007 |
| WO | WO 2009/143164 | A1 | 11/2009 |

OTHER PUBLICATIONS

International Preliminary Report on Patentability dated Feb. 21, 2012 for corresponding International Patent Application No. PCT/US2011/025477.

International Search Report and Written Opinion dated Apr. 19, 2011 for corresponding International Patent Application No. PCT/US2011/025477.

Office Action dated Aug. 19, 2013 corresponding to Australian Patent Application No. 2011218816, 5 pp.

Japanese Office Action dated Jul. 22, 2014 for Japanese application No. 2012-555057.

* cited by examiner

*Primary Examiner* — Timothy L Maust

(74) *Attorney, Agent, or Firm* — Ohlandt, Greeley, Ruggiero & Perle, LLP

(57) ABSTRACT

A dispensing system is provided that includes a vessel having a base portion with an aperture, and a dispenser containing a control system. The dispensing system controls the flow of a liquid into the vessel to provide for a rapid fill.

31 Claims, 28 Drawing Sheets

DISPENSING SYSTEM AND METHOD OF CONTROLLING THE SYSTEM

CROSS-REFERENCED APPLICATIONS

This application claims priority to U.S. Provisional Application No. 61/308,753, filed on Feb. 26, 2010, which is incorporated herein in its entirety by reference thereto.

BACKGROUND

1. Field of the Disclosure

The present disclosure relates to a dispensing system. More specifically, the present disclosure relates to a dispensing system that controls the flow of a liquid through a base portion of a vessel to provide for a rapid fill.

2. Description of Related Art

In many venues today it is essential to have a beverage dispensing system that can provide for extremely high demand from consumers within a very limited time period. To accomplish this, the beverage must be dispensed at a rapid rate while keeping the amount of fobbing or foaming to a minimum. These venues can include stadiums, arenas, concerts, sporting events, conferences, bars, taverns, festivals and other events or gatherings.

Traditionally, top pour dispensing systems have been utilized to provide beverages to consumers. These systems dispense the beverage into the top opening of the vessel, via a tap or fountain dispenser. However, top pour systems often generate high turbulence as the beverage drops into the vessel causing an increase in fobbing or foaming. This greatly decreases the rate at which a beverage can be dispensed. Consequently, top pouring systems cannot support the dispense rate required at many high demand venues.

Developments have been made in an effort to decrease the time it takes to fill a vessel with a beverage and to meet the high pace and high volume demands of consumers. In particular, products have been designed to dispense a beverage into a vessel using a bottom fill method.

Current bottom fill products have increased the dispensing speed into a vessel. However, they have failed to address the increase in fobbing and foaming associated with dispensing a carbonated product into a vessel at such speeds. In addition, many new dispensing systems are not compatible with conventional beverage cooling systems used today. Thus, a user is required to remove the existing system and install a particular beverage cooling systems to provide the increased filling rate. This results in a timely and expensive process for the user.

Accordingly, there is a need for a beverage dispensing system that provides a rapid fill with minimal fobbing or foaming. Furthermore, there is a need for a beverage dispensing system that is compatible with conventional beverage cooling systems to provide a convenient and low cost transition.

SUMMARY

The present disclosure provides for a dispensing system having a dispenser and a vessel, where the dispensing system provides for a rapid fill with minimal fobbing or foaming.

The present disclosure further provides for the vessel having a base portion and a cup portion. The base portion further comprises a base wall and base floor. The base wall and/or the base floor may have a depression where an aperture for receiving liquid can be located. The aperture may further contain a valve. The base floor has an inclined path for directing the flow of liquid into a vortex.

The present disclosure further provides for the dispenser having a housing with a holding area for receiving a vessel. The holding area further comprises a protuberance corresponding to the depression of the vessel to provide the correct orientation and a secure fit. The dispenser has a nozzle that is inserted into the aperture of the vessel for dispensing liquid.

The dispenser further comprises a control system for regulating the flow of liquid into the vessel. The control system can detect the proper placement and removal of a vessel on or from the dispenser, respectively, as well as measure the volume and flow of liquid from the nozzle to the vessel, thereby ensuring that each cup receives a predetermined quantity of beverage without any overages or incomplete fills, which eliminates product losses or labor required to manually fill the cup to it proper level.

A beverage dispensing system comprising: a dispenser assembly which comprises a housing, a dispenser base portion disposed within said housing, a first alignment mechanism, and a beverage dispensing nozzle; and a vessel which comprises a vessel base portion and an upper portion, wherein said vessel base portion comprises a first receiver configured to receive said first alignment mechanism, and an aperture disposed in said first receiver, wherein said first alignment mechanism causes the alignment of said beverage dispensing nozzle with said aperture disposed in said vessel base portion and seating of said vessel within said dispenser base portion.

The beverage dispensing system further comprises at least one second alignment mechanism disposed on a surface of said dispenser base portion, and a second receiver disposed about an exterior bottom surface of said vessel base portion for receiving said second alignment mechanism to further assist in the alignment of said vessel within said dispenser assembly.

The dispenser base portion comprises an open front portion, a bottom portion and at least one side wall disposed about said bottom portion, and wherein said second alignment mechanism is a ridge portion disposed on said bottom of said base portion so as to receive said second receiver of said vessel, thereby insuring that said dispensing nozzle aligns with and is received by said aperture of said vessel.

The beverage dispensing system further comprises a sensor for detecting the presence of said vessel, thereby allowing beverage to flow from said beverage dispensing nozzle into said vessel.

The first alignment mechanism is disposed about said nozzle and wherein said first recessed portion is formed about said aperture, wherein when said first alignment mechanism is properly seated within said first recessed portion, said nozzle enters said aperture.

The aperture includes a valve which allows for said nozzle to penetrate into said interior of said vessel about said vessel base portion and, upon activation of said dispenser, beverage passes from said nozzle into the interior of said vessel.

The beverage valve is either a one-way valve or a non-return valve.

The vessel further comprises an upwardly sloped incline radially disposed about the interior of said vessel base portion, such that said beverage entering said vessel via said aperture will travel substantially up said ramp, such that said beverage passes over said aperture upon traversing approximately 360 degrees around the circumference of the interior of said vessel.

The beverage dispensing system further comprises a controller which upon receiving a signal from said sensor activates a pump to distribute said beverage to said nozzle and into said vessel and deactivates said pump when the predetermined quantity of beverage has been received by said vessel.

The first recessed portion of said vessel is a shape substantially similar to said first alignment mechanism to permit a substantially female to male connection therebetween.

The shape is selected from the group consisting of: a rectangle, a square and cylindrical.

A beverage dispenser assembly comprising: a housing; a base portion disposed within said housing; a beverage dispensing nozzle; and at least one alignment mechanism disposed within said base portion to cause alignment of said beverage dispensing nozzle with a vessel to be filled with a beverage.

The beverage based portion comprises an open front portion, a bottom portion and at least one side wall disposed about said bottom portion, and wherein said alignment mechanism is at least one selected from the group consisting of: a ridge portion disposed on said bottom portion of said base portion so as to received said vessel, and a perturbation extending from said side wall of said base portion into a receiving portion of said vessel.

The beverage dispenser assembly further comprises a sensor for detecting the presence of said vessel, thereby allowing beverage to flow from said beverage dispensing nozzle into said vessel.

The beverage dispenser assembly further comprises a controller which upon receiving a signal from said sensor activates a pump to distribute said beverage to said nozzle and deactivates said pump when the predetermined quantity of beverage has passed through said nozzle.

The perturbation extending from said side wall has a shape selected from the group consisting of: a rectangle, a square and cylindrical.

A vessel comprising: a base portion; and an upper portion, wherein said base portion comprises: a first receiver disposed about said base portion and configured to receive a first dispenser alignment mechanism, and an aperture disposed in said first receiver to receive a nozzle.

The vessel further comprises at least one second receiver disposed about an exterior bottom surface of said vessel base portion for receiving said second dispenser alignment mechanism.

A method for dispensing a beverage into a vessel comprising: activating a beverage dispenser assembly which comprises a housing, a dispenser base portion disposed within said housing, a first alignment mechanism, a power source and a beverage dispensing nozzle; placing a vessel which comprises a vessel base portion and an upper portion on to said dispenser base portion, wherein said vessel base portion comprises a first receiver and an aperture disposed in said first receiver; aligning said first receiver of said vessel with said first alignment mechanism of said dispenser assembly, thereby causing the alignment of said beverage dispensing nozzle with said aperture disposed in said vessel base portion and seating of said vessel within said dispenser base portion.

The at least one second alignment mechanism is disposed on a surface of said dispenser base portion, and a second receiver is disposed about an exterior bottom surface of said vessel base portion for receiving said second alignment mechanism to further assist in the alignment of said vessel within said dispenser assembly.

The dispenser base portion comprises an open front portion, a bottom portion and at least one side wall disposed about said bottom portion, and wherein said second alignment mechanism is a ridge portion disposed on said bottom of said base portion so as to receive said second receiver of said vessel, thereby insuring that said beverage dispensing nozzle aligns with and is received by said aperture of said vessel.

The method further comprises detecting the presence of said vessel in said dispenser base portion and seating of said nozzle within said aperture; and passing a beverage from said beverage dispensing nozzle into said vessel.

The aperture includes a valve which allows for said nozzle to penetrate into said interior of said vessel about said vessel base portion and, after activation of said dispenser, beverage passes from said nozzle into the interior of said vessel.

BRIEF DESCRIPTION OF THE DRAWINGS

Other and further benefits, advantages and features of the present disclosure will be understood by reference to the following specification in conjunction with the accompanying drawings, in which like reference characters denote like elements of structure and.

DETAILED DESCRIPTION OF THE PREFERRED EMBODIMENT

Figure 1:
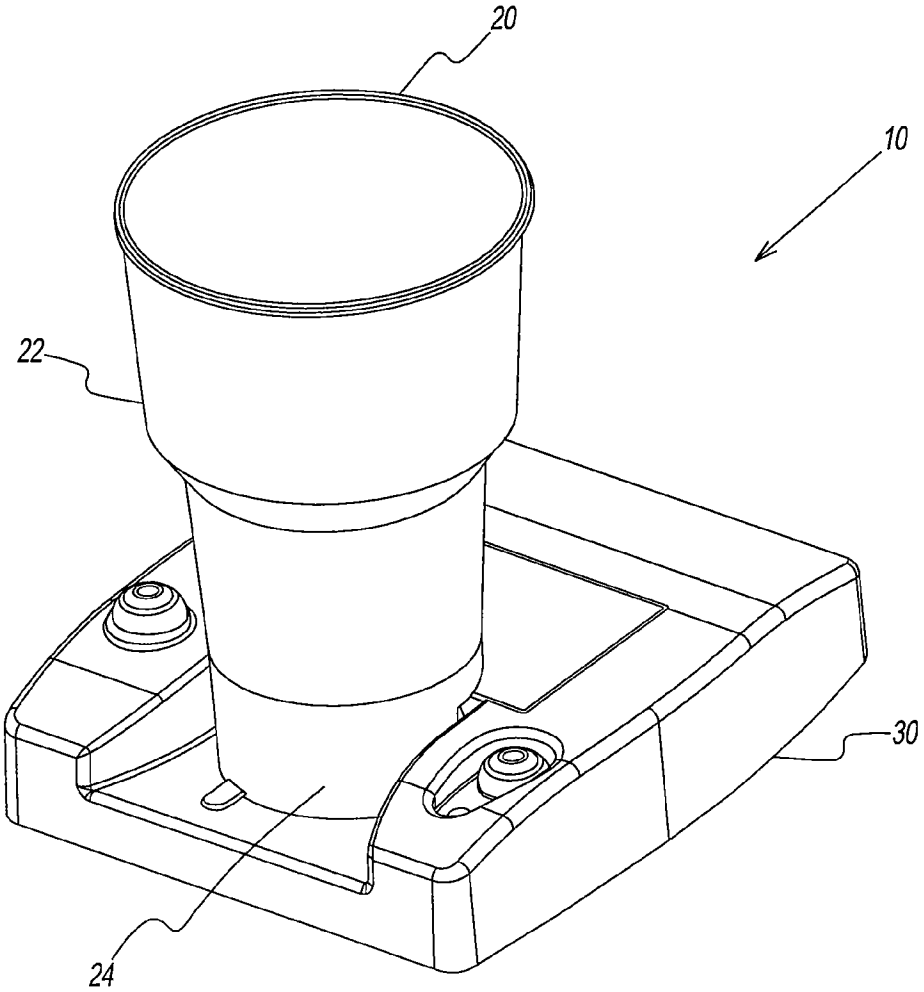
FIG. 1 is a perspective view of a dispensing system of the present disclosure.

Referring to the drawings, a beverage dispensing system according to the present disclosure is shown and generally referenced to by numeral 10. Beverage dispensing system 10 includes a vessel 20 that can be removably disposed on a dispenser 30, as shown in FIG. 1. Vessel 20 is designed to contain a liquid received from dispenser 30. Dispenser 30 may contain a control system to regulate the use of dispensing system 10. Beverage dispensing system 10 can effectively control the flow of any type of liquid, carbonated or non-carbonated, such as water, beer, soft drinks, smoothies or other beverage, through dispenser 30 and into vessel 20. Thus, beverage dispenser system 10 can provide for the rapid dispensing of liquids in a very short period of time.

Figure 6:
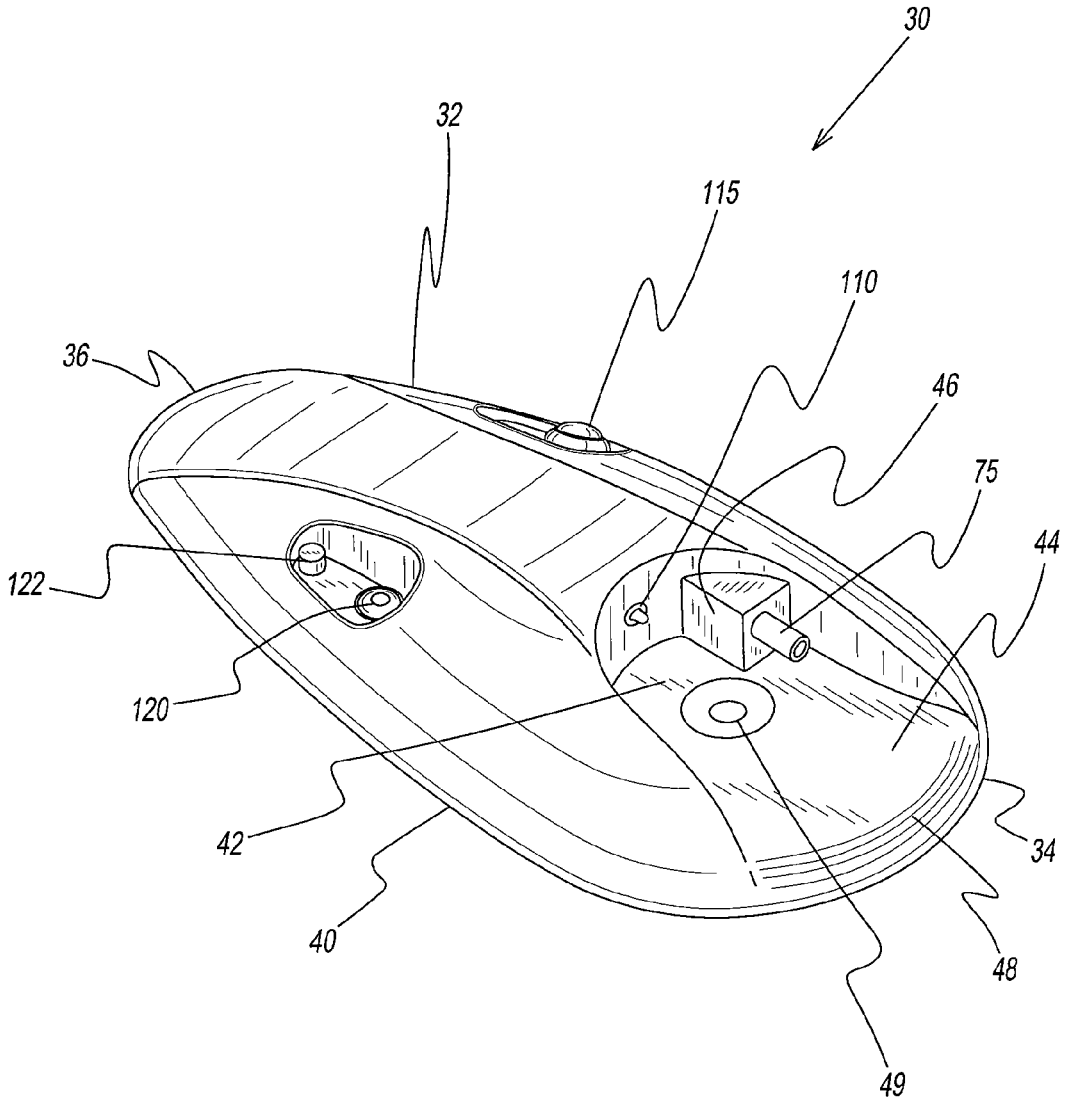
FIG. 6 is a perspective view of a dispenser of the present disclosure.
Figure 7:
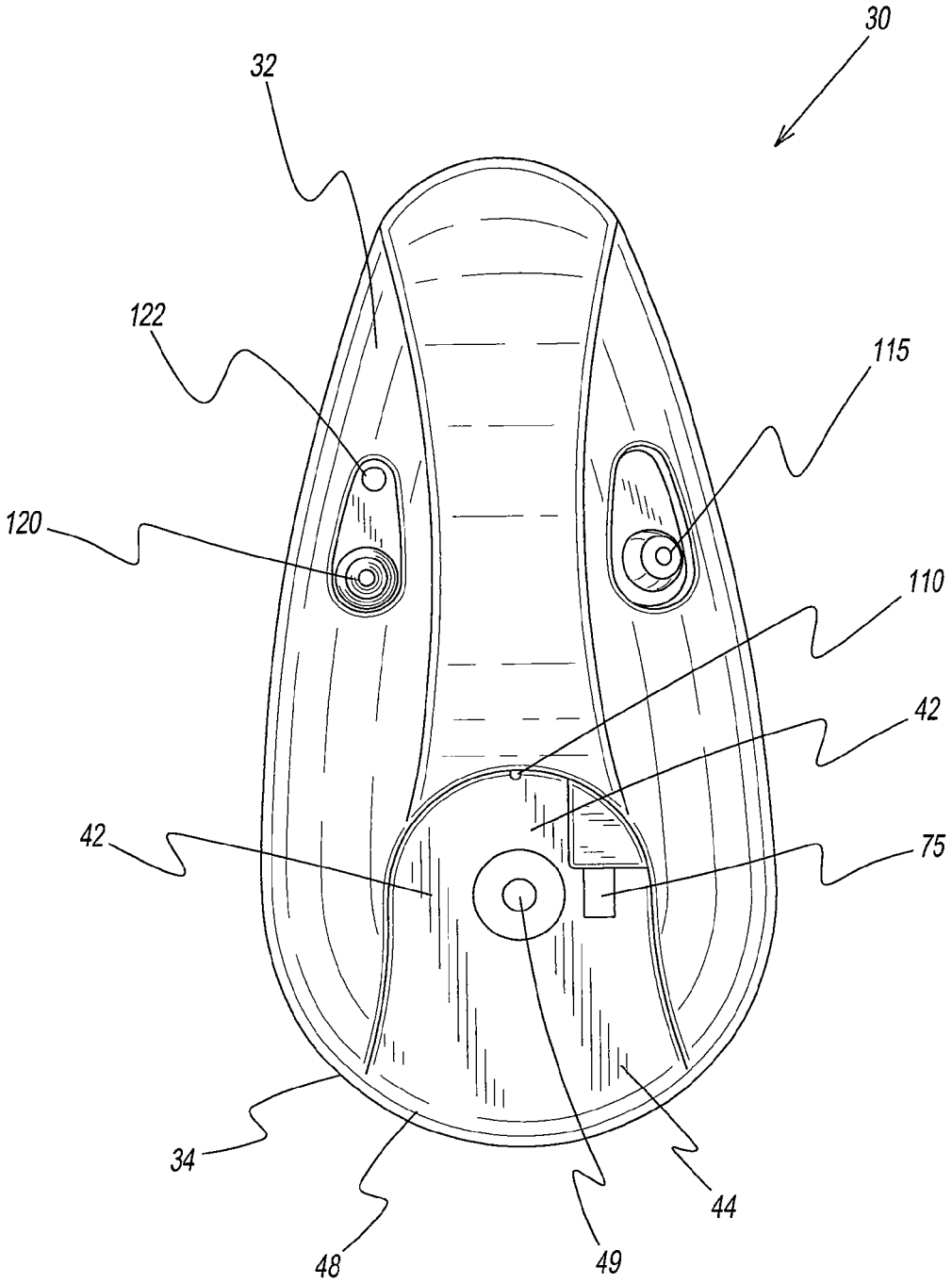
FIG. 7 is a top view of a dispenser of FIG. 6.

As shown in FIGS. 2-5, dispenser 30 contains a housing 32 having at least a first end 34, a second end 36, an upper panel 38 and a lower panel 40. Housing 32 can be made out of any durable material, such as, but not limited to plastic, metal or other similar material. Preferably, housing 32 is made of acrylonitrile butadiene styrene (ABS) plastic. Furthermore, it is preferred that housing 32 has smooth edges and corners, instead of sharp pointed surfaces, to avoid an injury to a user of dispensing system 10. Housing 32 can be designed in any shape, including but not limited to rectangle (FIGS. 2-5), oval (FIGS. 6, 7 and 25), square, round or any other similar shape.

Figure 2:
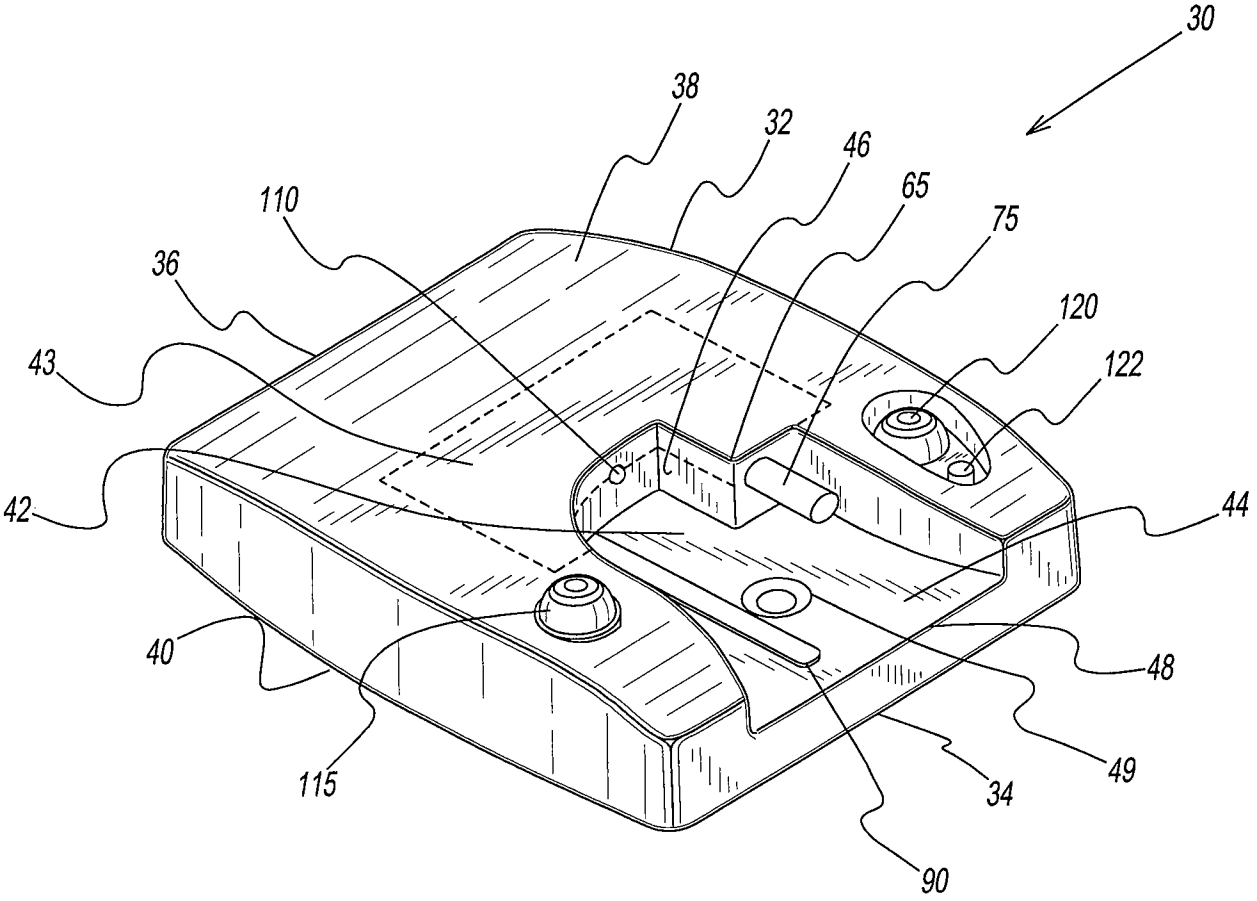
FIG. 2 is a perspective view of a dispenser of the present disclosure.
Figure 3:
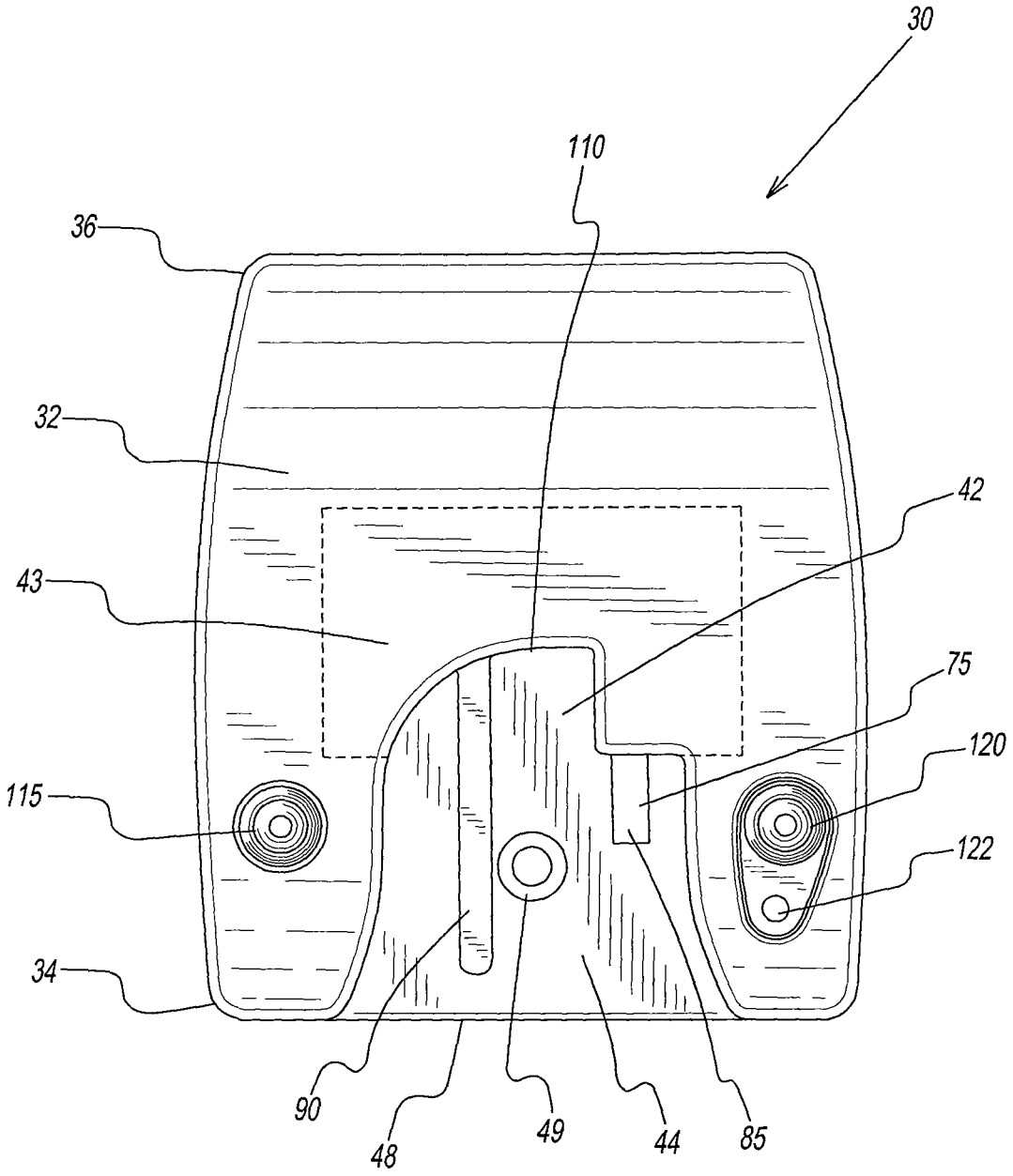
FIG. 3 is top view of the dispenser of FIG. 2.
Figure 19:
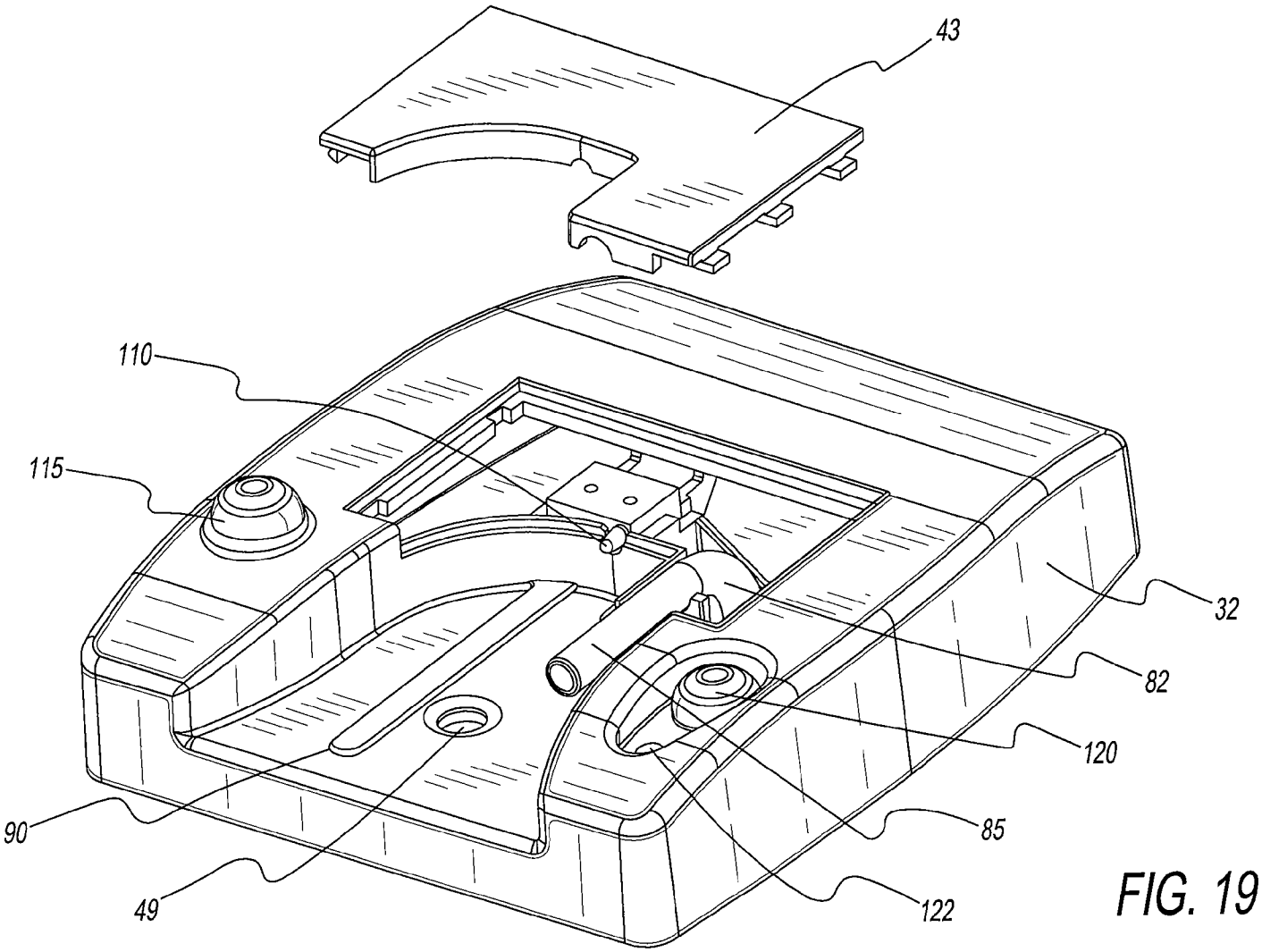
FIG. 19 is a perspective view of a dispenser of the present disclosure, showing a control system.
Figure 28:
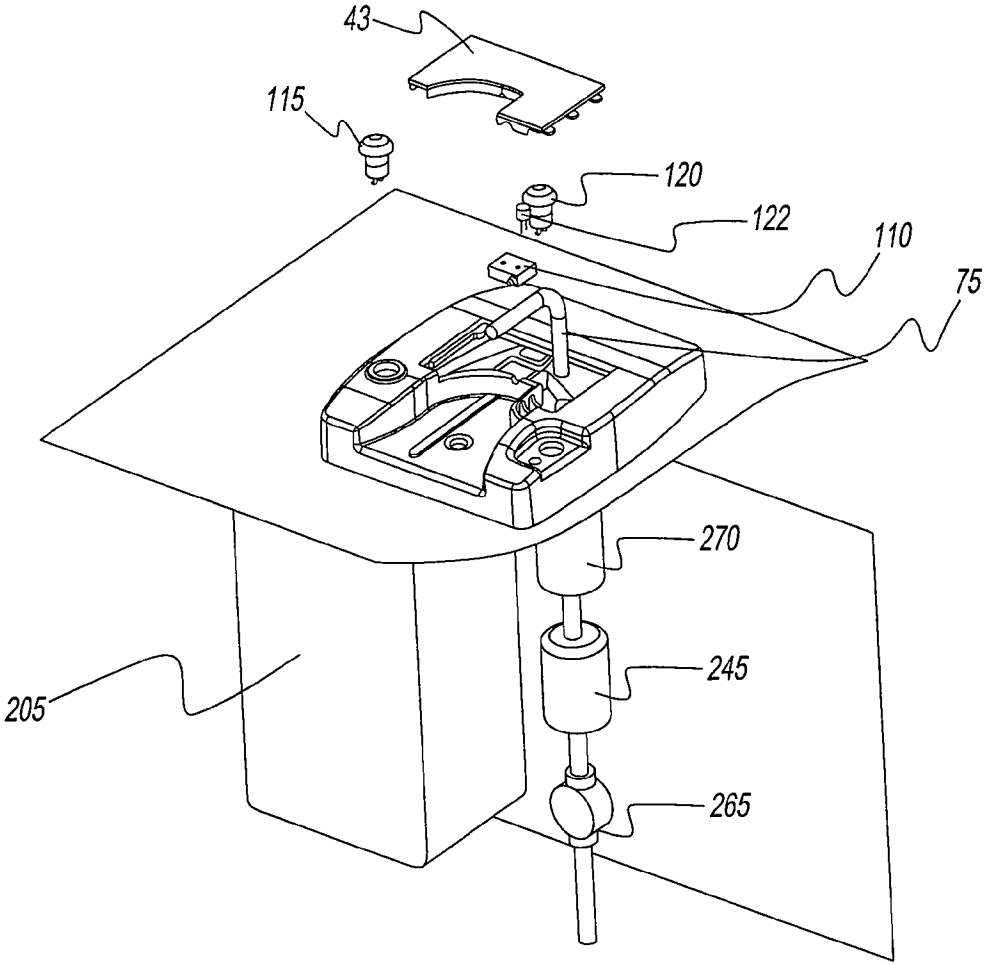
FIG. 28 is an exploded view of a dispenser and control system of the present disclosure.
Figure 29:
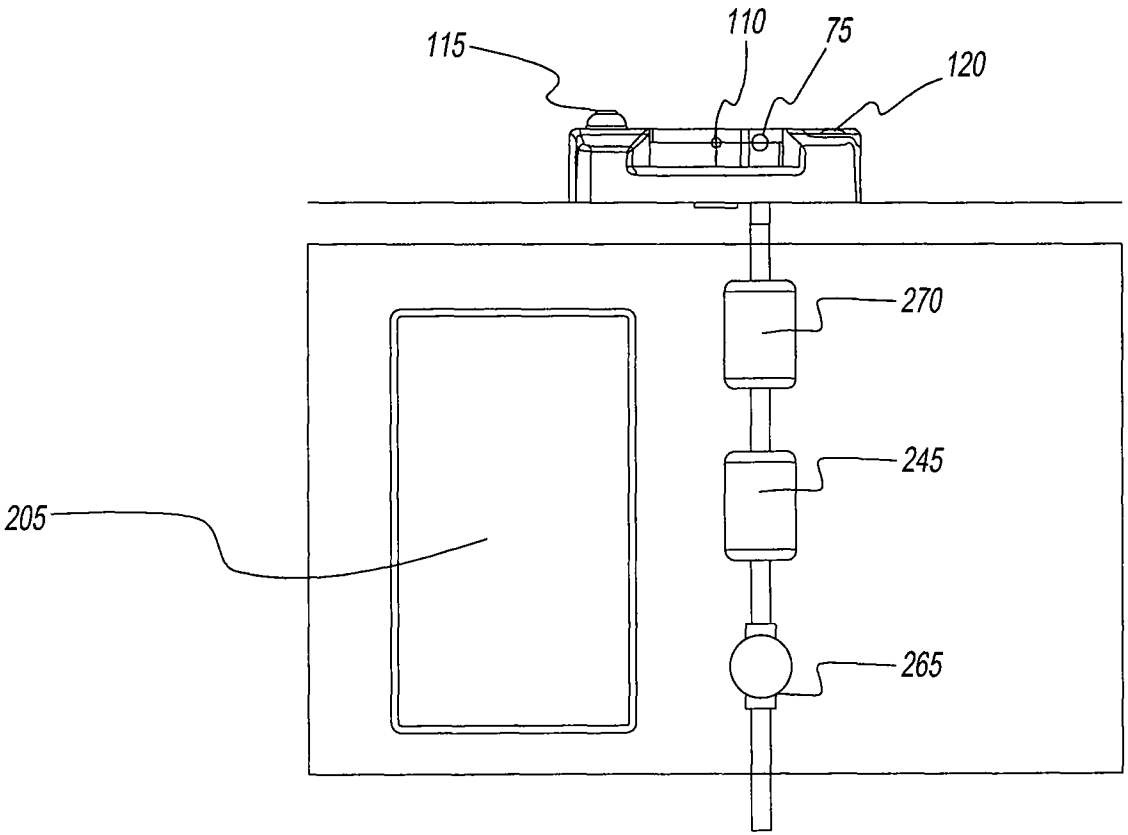
FIG. 29 a front view of a dispenser and control system of the present disclosure.

As shown in FIGS. 2 and 3, housing 32 contains a holding area 42 to receive vessel 20. Holding area 42 has a floor 44 and an inner wall 46 that defines the shape thereof. Holding area 42 can be designed to have any shape or area that is sufficient to securely hold vessel 20. Preferably, holding area 42 has a receiving area 48 along first end 34 where inner wall 46 is not present, as shown in FIG. 2. This allows a user to easily and quickly load and unload vessel 20 onto dispenser 30. As shown in FIG. 2, floor 44 may contain an outlet 49 which allows excess liquid to be removed holding area 42. Housing 32 may have a removable panel 43 to access a control system, as shown in FIGS. 19, 28 and 29.

As shown in FIG. 8-13, vessel 20 has a cup portion 22 that is connected to a base portion 24. Vessel 20 can have any shape or style such as, for example, cylindrical, square, rectangle or any other shape. However, it is preferred that vessel 20 has a substantially cylindrical shaped defining an inner volume 25 for containing a liquid.

Figure 8:
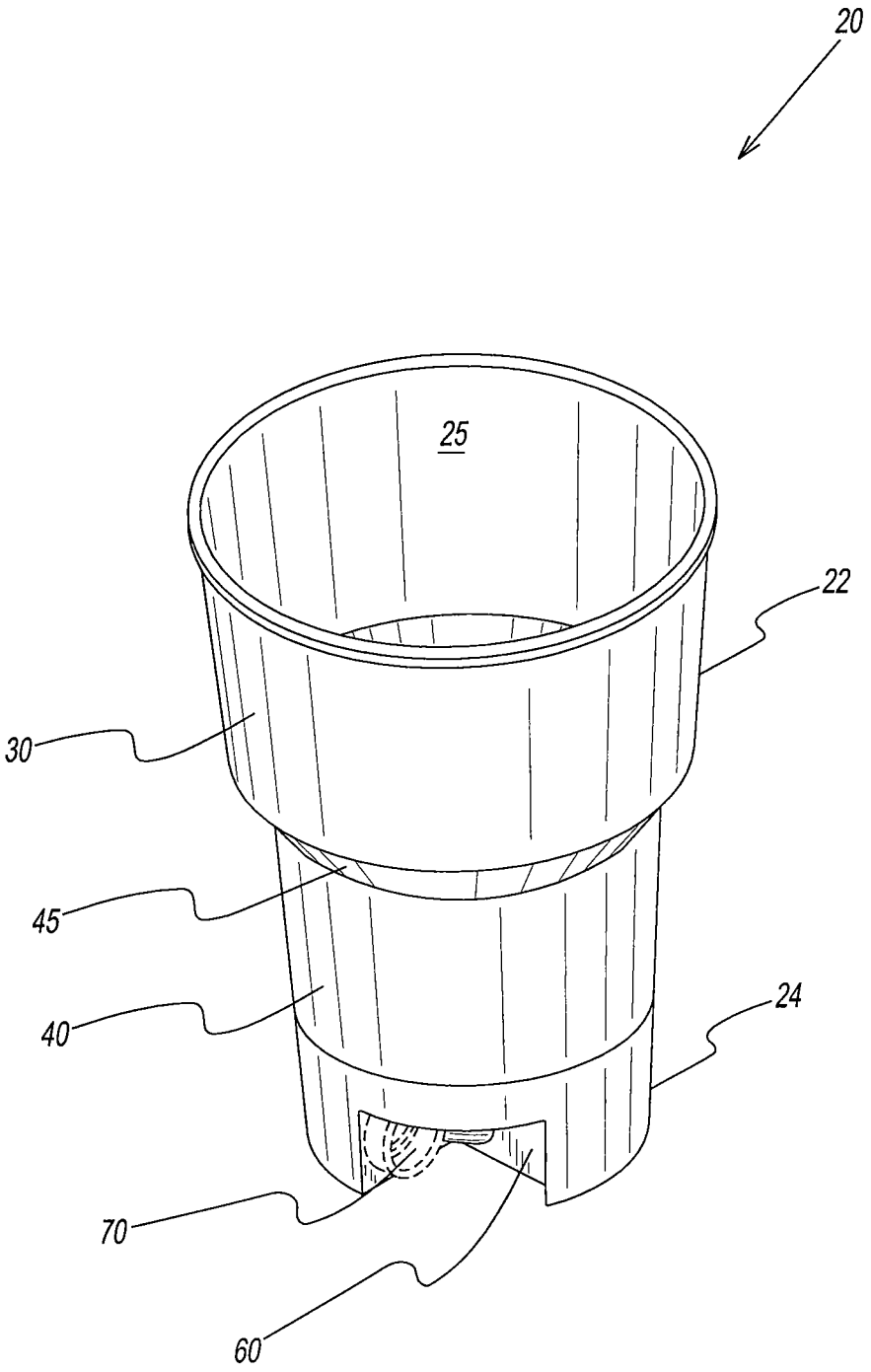
FIG. 8 is a top perspective view of a vessel of the present disclosure.
Figure 9:
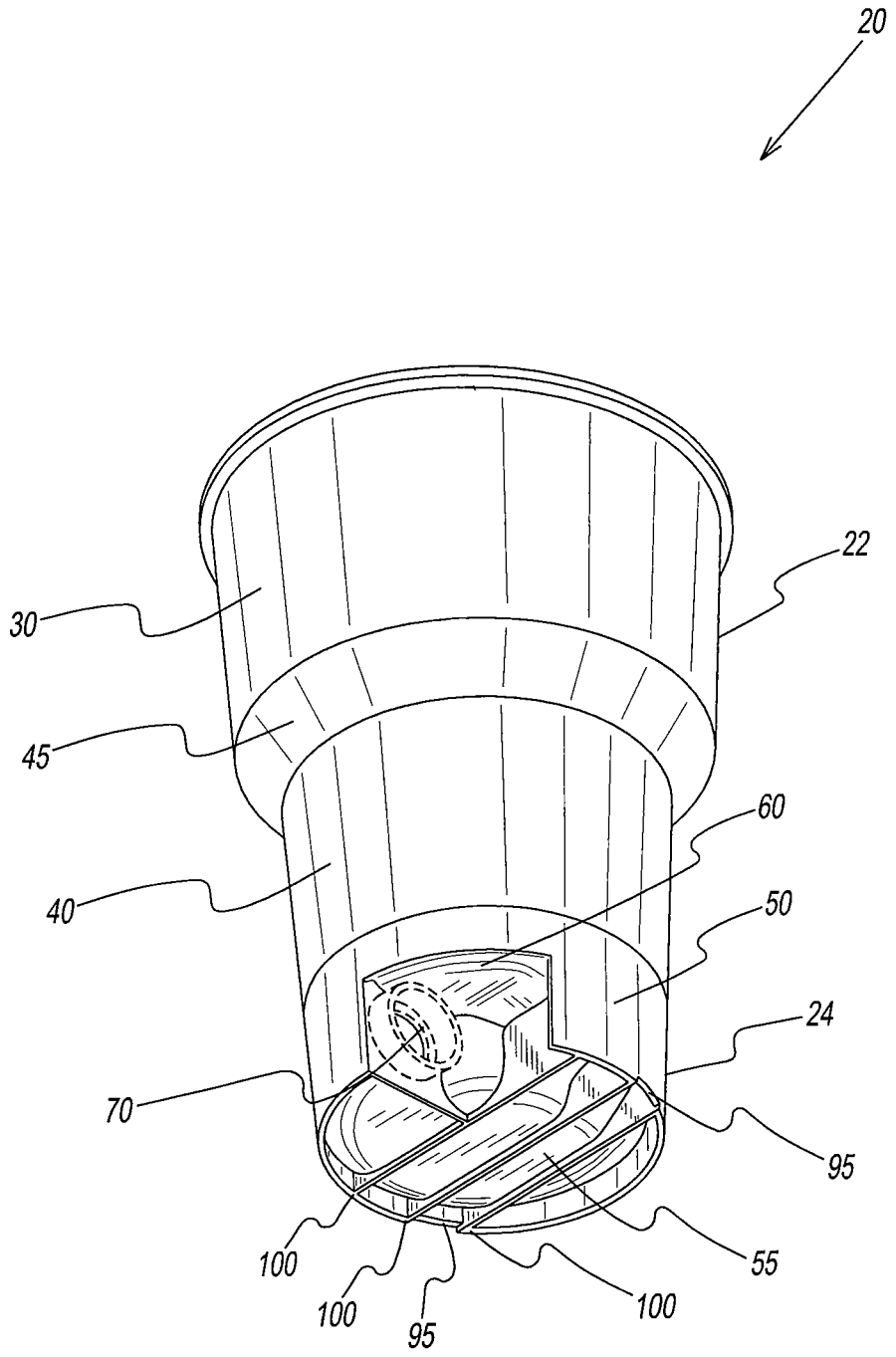
FIG. 9 is a bottom perspective view of the vessel of FIG. 8.

Cup portion 22 has a top portion 30 having an opening 36 and a bottom portion 40 connected to base portion 24. Top portion 30 and bottom portion 40 can have the same or different diameters. Preferably, bottom portion 40 has a smaller diameter than top portion 30. Cup portion 22 may also contain a middle portion 45 that provides a transition from top portion 30 to bottom portion 40, as shown in FIGS. 8 and 9. Alternative shapes and diameters can also be used for vessel 20, such as, for example, tapered, hourglass, and the like.

Vessel 20 can be disposable or reusable, and made of any durable material such as, but not limited to, plastic, paper, etc. Preferably, vessel 20 is made of a recyclable food grade polypropylene material. Furthermore, vessel 20 can be designed to accommodate any volume of liquid within inner volume 25, preferably, 1 pint (UK), ½ liter (EU) and 16 fluid ounces (US).

Figure 14:
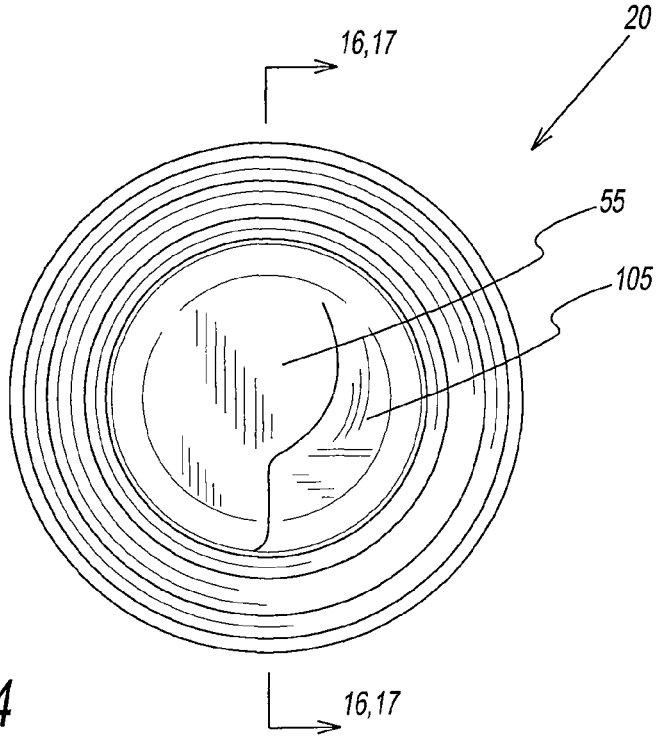
FIG. 14 is a top view of the vessel of FIG. 8.
Figure 16:
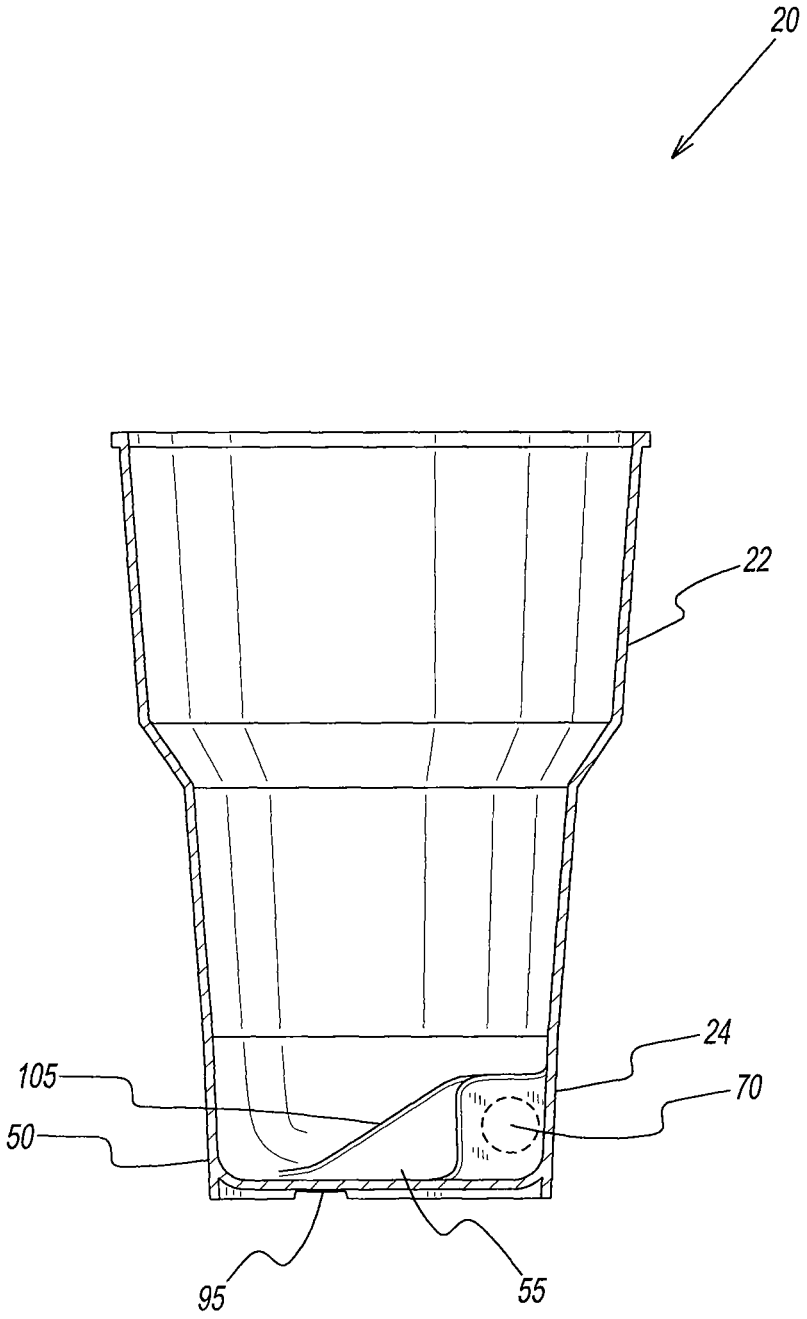
FIG. 16 is a front view of a cross section taken along line 16-16 of the vessel of FIG. 14.
Figure 17:
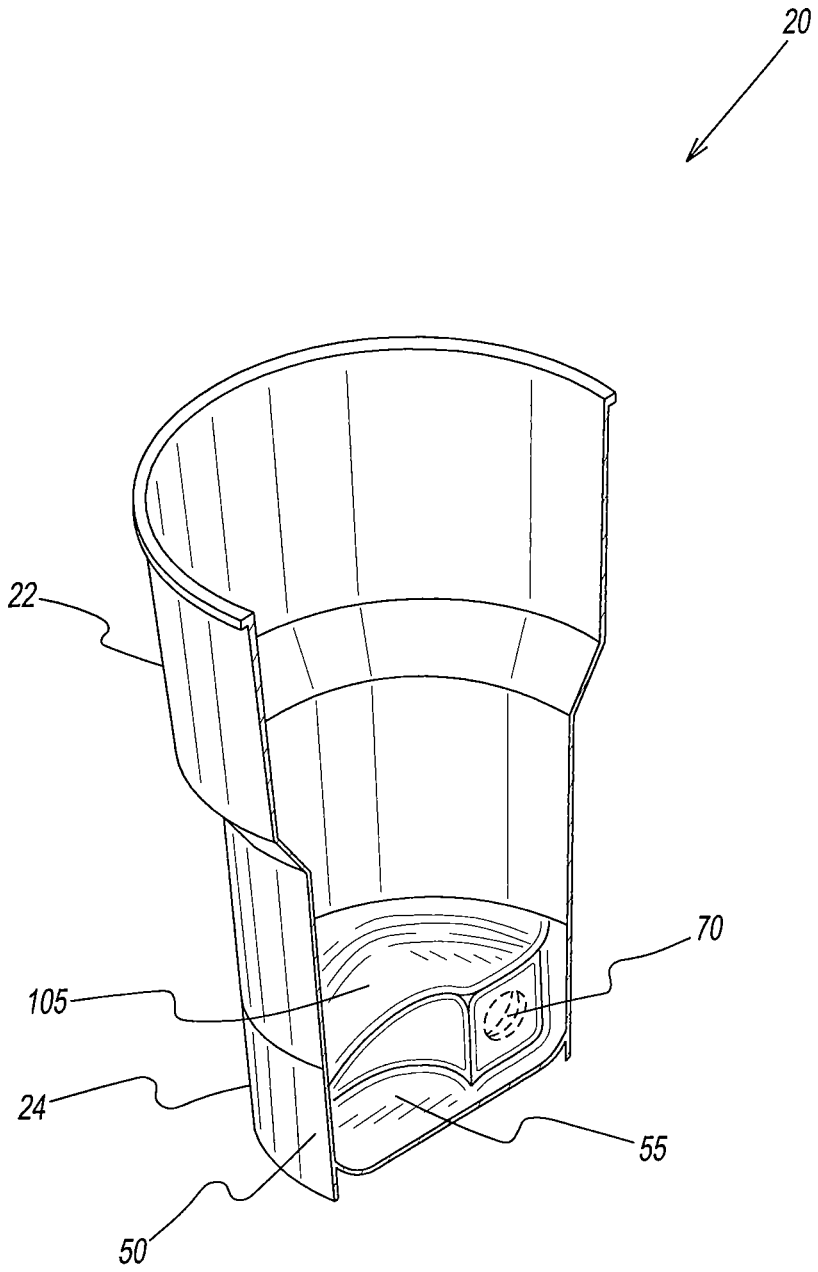
FIG. 17 is a perspective view of a cross section taken along line 17-17 of the vessel of FIG. 14.

As shown in FIGS. 16 and 17 which are cross sectional views of FIG. 14, base portion 24 has a base wall 50 and base floor 55. Base wall 50 will have a shape and size that fits within holding area 42 of dispenser 30. Base portion 24 may have a depression 60 within base wall 50 and/or base floor 55 as shown in FIGS. 8 and 9. Depression 60 will correspond to a protuberance 65 within holding area 42 of dispenser 30. This provides a user of dispensing system 10 a number of benefits, such as, an easy guide for placing vessel 20 on dispenser 30 in the proper orientation, and a secure fit on holding area 42 during dispensing of a liquid.

Depression 60 and protuberance 65 can have any corresponding shape or size, such as, for example, square, rectangle, round, and the like. In one embodiment, as shown in FIG. 2, protuberance 65 has a square shape formed by inner wall 46 of dispenser 30 that corresponds with depression 60 having a square shape formed within base wall 50 of vessel 20, as shown in FIG. 9.

Base portion 24 of vessel 20 can have an aperture 70 through any area of base wall 50 and/or base floor 55 for receiving liquid from dispenser 30. When aperture 70 is positioned through base wall 50, vessel 20 is filled with liquid by side filling. When aperture 70 is positioned through base floor 55, vessel 20 can be filled with liquid by bottom filling. Preferably, aperture 70 is located within depression 60.

Figure 4:
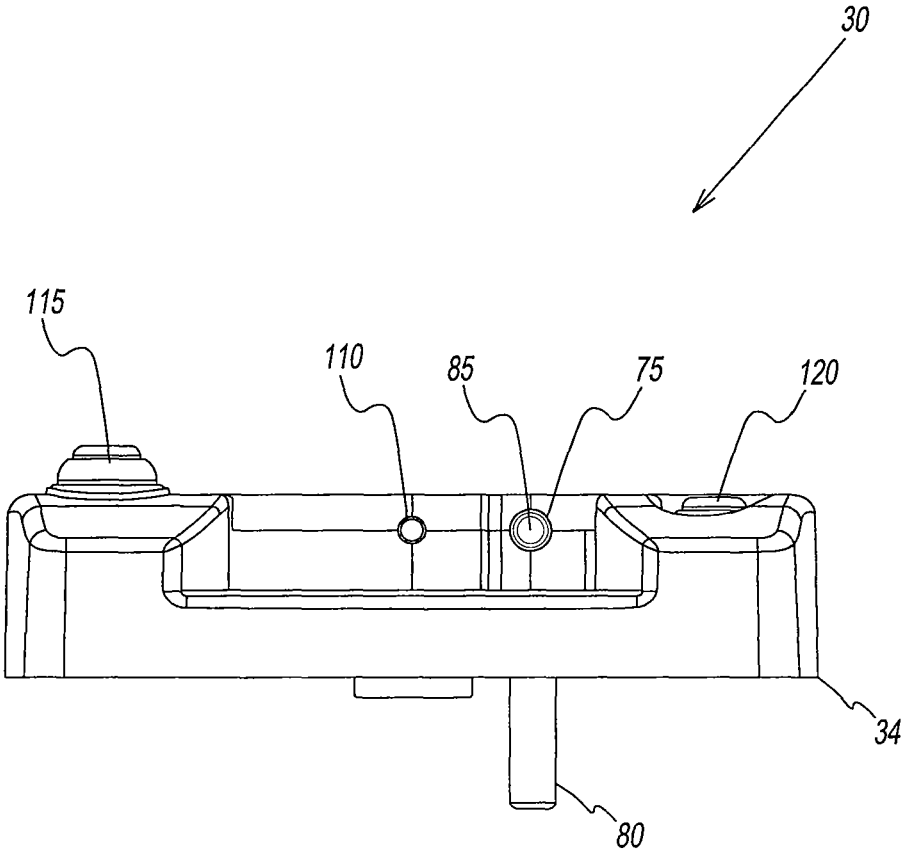
FIG. 4 is a front view of the dispenser of FIG. 2.
Figure 5:
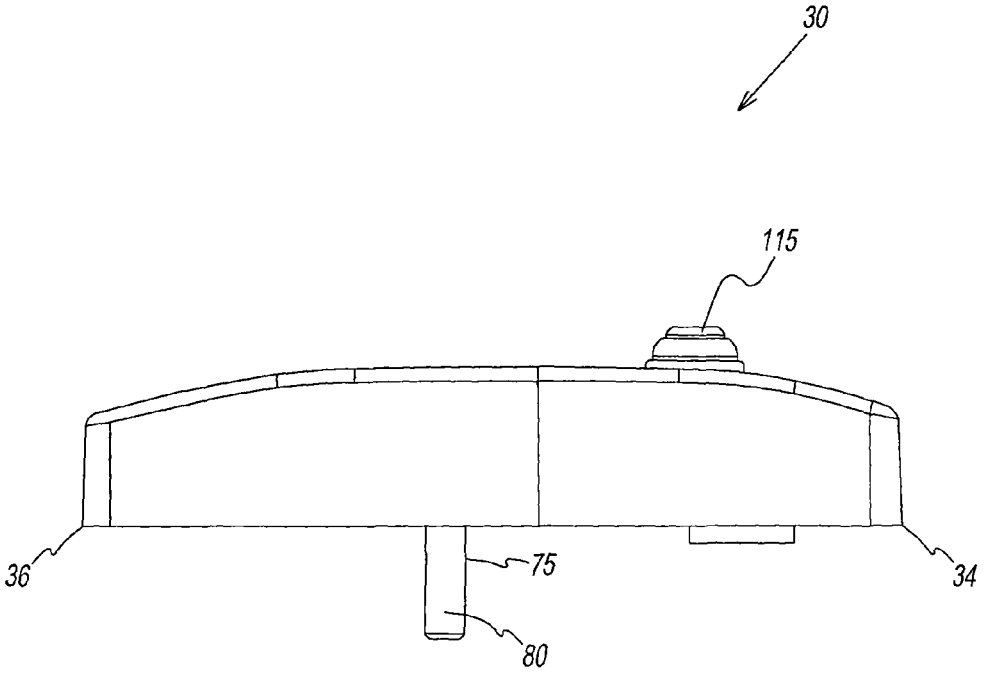
FIG. 5 is a side view of the dispenser of FIG. 2.

As shown in FIGS. 4, 5 and 19, dispenser 30 has a nozzle 75 that runs continuously through dispenser 30 having an inlet end 80, a middle area 82 and an outlet end 85. Preferably, middle area 82 of nozzle 75 is contained within housing 32, as shown in FIG. 19, while inlet end 80 and outlet end 85 protrude outside housing 32. More preferably, inlet end 80 of nozzle 75 exits housing 32 at bottom portion 40 where it receives a flow of liquid, such as a beverage, from an outside supply source. Furthermore, it is preferred that outlet portion 85 exits housing 32 within holding area 42, and more preferably through the inner wall 46 of protuberance 65, as shown in FIG. 3.

Aperture 70 of vessel 20 corresponds with nozzle 75. When vessel 20 is placed in the correct orientation within holding area 42 by a user, nozzle 75 may be introduced into aperture 70. Aperture 70 and nozzle 75 can have any shape or size, such as cylindrical, square or any other shape. It is preferred that aperture 70 and nozzle 75 have cylindical shape, where the diameter of nozzle 75 is less than aperture 70 to create a secure fit. Vessel 20 can be removably disposed from nozzle 75.

Figure 18:
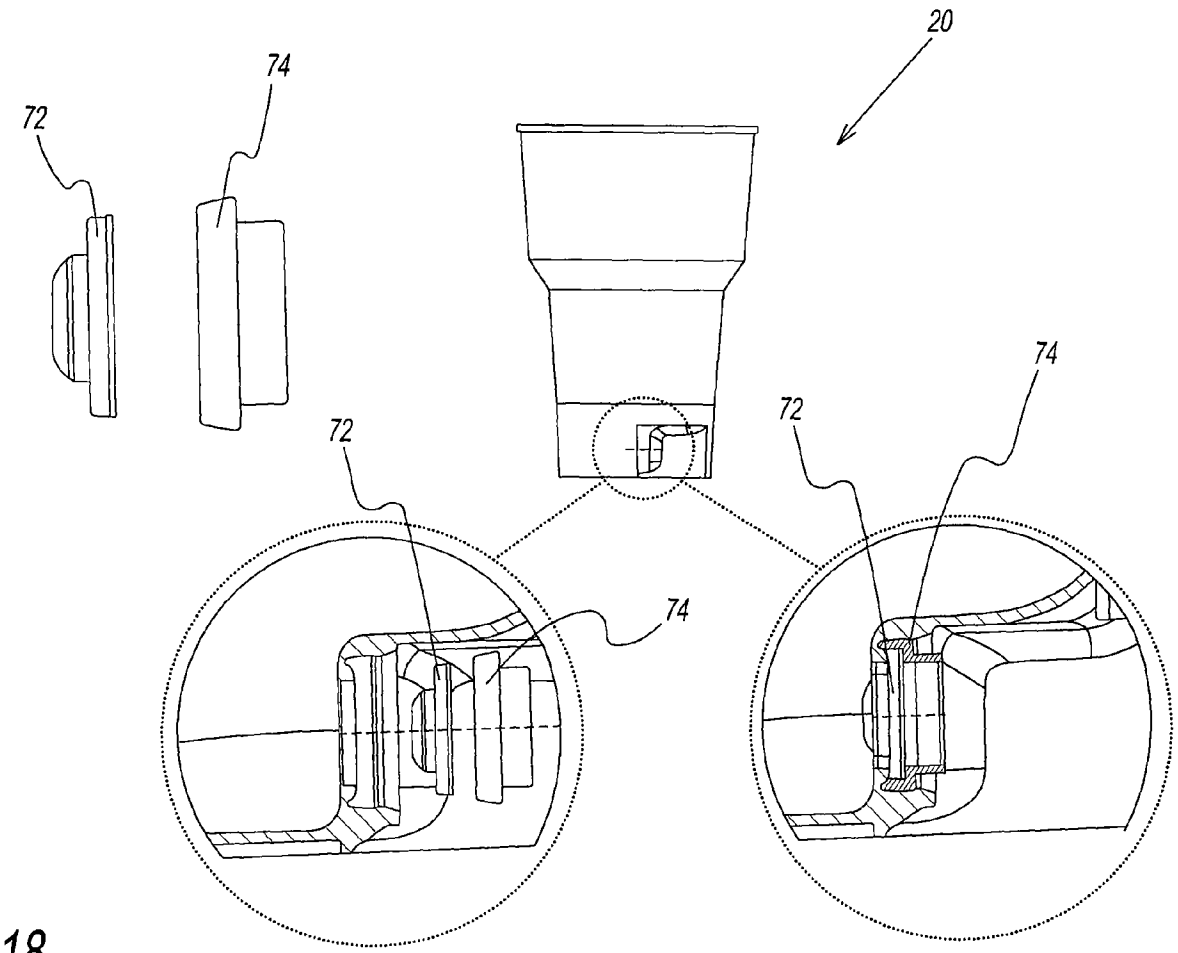
FIG. 18 shows an enlarged view of a valve and a ring of the vessel of the present disclosure.

Aperture 70 of vessel 20 may contain a valve 72. Preferably, valve 72 is a one-way or non-return valve which allows liquid to enter aperture 70, but prevents the liquid from flowing back out. Valve 72 may be made of any material, such as, for example, silicon, or other similar material. Valve 72 may be secured onto aperture 70 by a ring 74. FIG. 18 shows valve 72 and ring 74 in proper orientation prior to attachment, and valve 72 and ring 74 attached to aperture 70.

Figure 13:
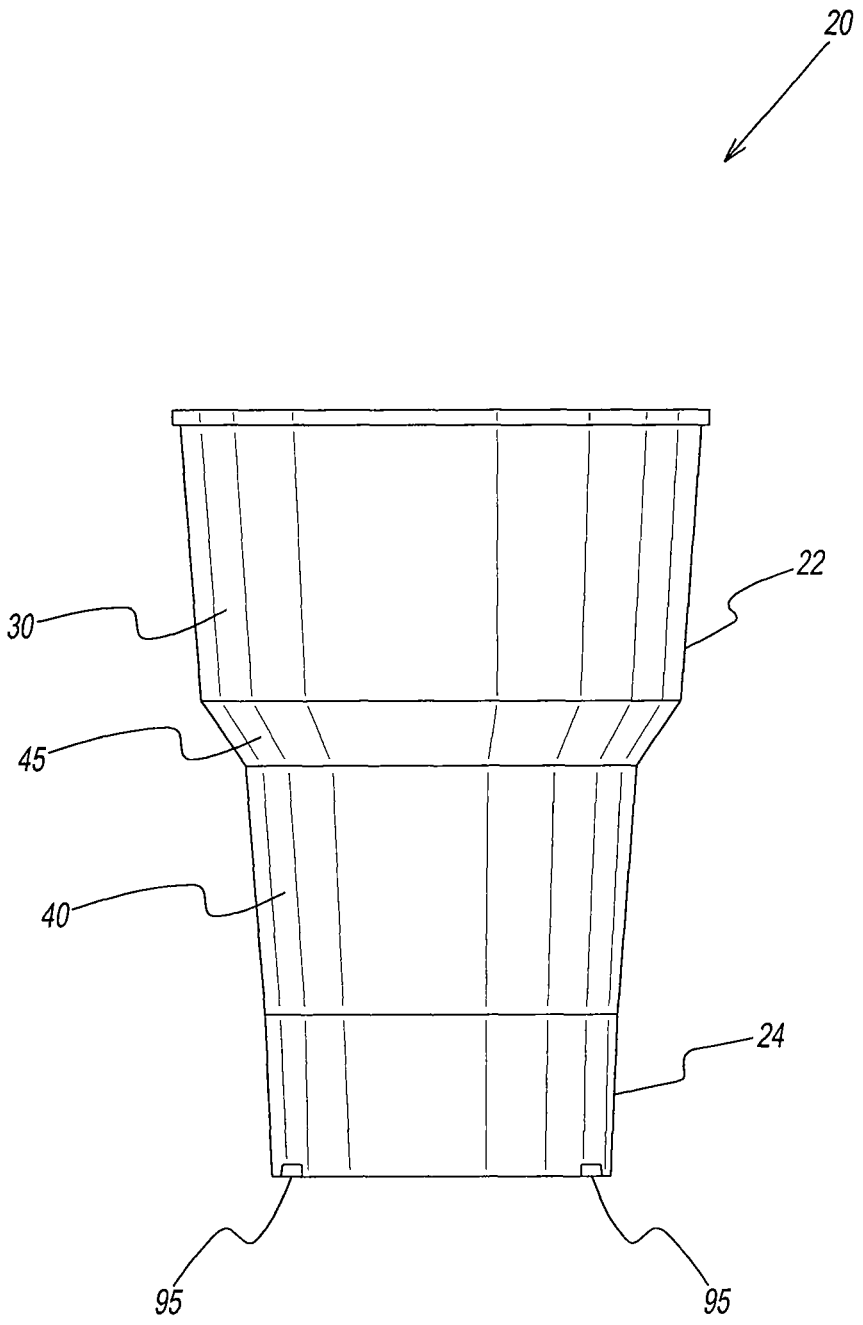
FIG. 13 is a fourth side view of the vessel of FIG. 8.

In addition to the alignment guidance provided to a user by protuberance 65, dispenser 30 may also contain a ridge 90, as shown in FIGS. 2 and 3. Ridge 90 functions to allow a user to engage vessel 20 in the correct orientation and more specifically, the correct alignment of aperture 70 with nozzle 75. Ridge 90 is a raised area, preferably on floor 44 of holding area 42 that corresponds with a recess 95 on base portion 24 of vessel 20. Preferably, base portion 24 has a pair of recesses 95, as shown in FIGS. 9 and 13.

Figure 15:
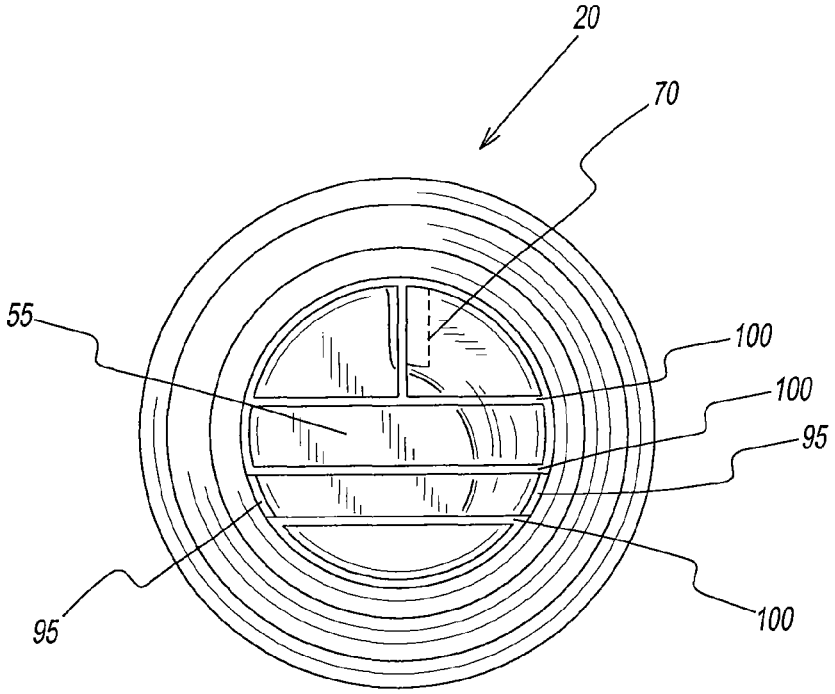
FIG. 15 is a bottom view of the vessel of FIG. 8.

Recesses 95 are generally on opposite sides of vessel 20 and are positioned to align with ridge 90. Recesses 95 are a size which allows vessel 20 to easily slide along floor 44 to engage nozzle 75 with aperture 70. Furthermore, base floor 55 may contain a series of ribs 100 to guide vessel 20 along ridge 90 and for additional support, as shown in FIGS. 9 and 15.

Once nozzle 75 is inserted into valve 72 of aperture 70, dispenser 30 can begin dispensing liquid into vessel 20. Liquid is rapidly dispensed into aperture 70 of base portion 24, which has an inner design to reduce fobbing and foaming of the liquid. The liquid enters base portion 24 and approximately 180 degrees from the entry point from aperture 70 it is directed toward an incline 105 of floor 44. Preferably, incline 105 has a curved shape along base wall 50 and gradually rises so that it allows the liquid to flow over depression 60 containing aperture 70, as shown in FIGS. 14, 16 and 17. Therefore, incline 105, along with the curvature of base wall 50, creates a flow path that causes the liquid to fill vessel 20 in a tight vortex stream and avoid contact with a wall of depression 60, which would otherwise result in an obstruction of the liquids vortex flow and, thus, create a much more turbulent flow and an increase in undesirable fobbing or foaming.

Figure 10:
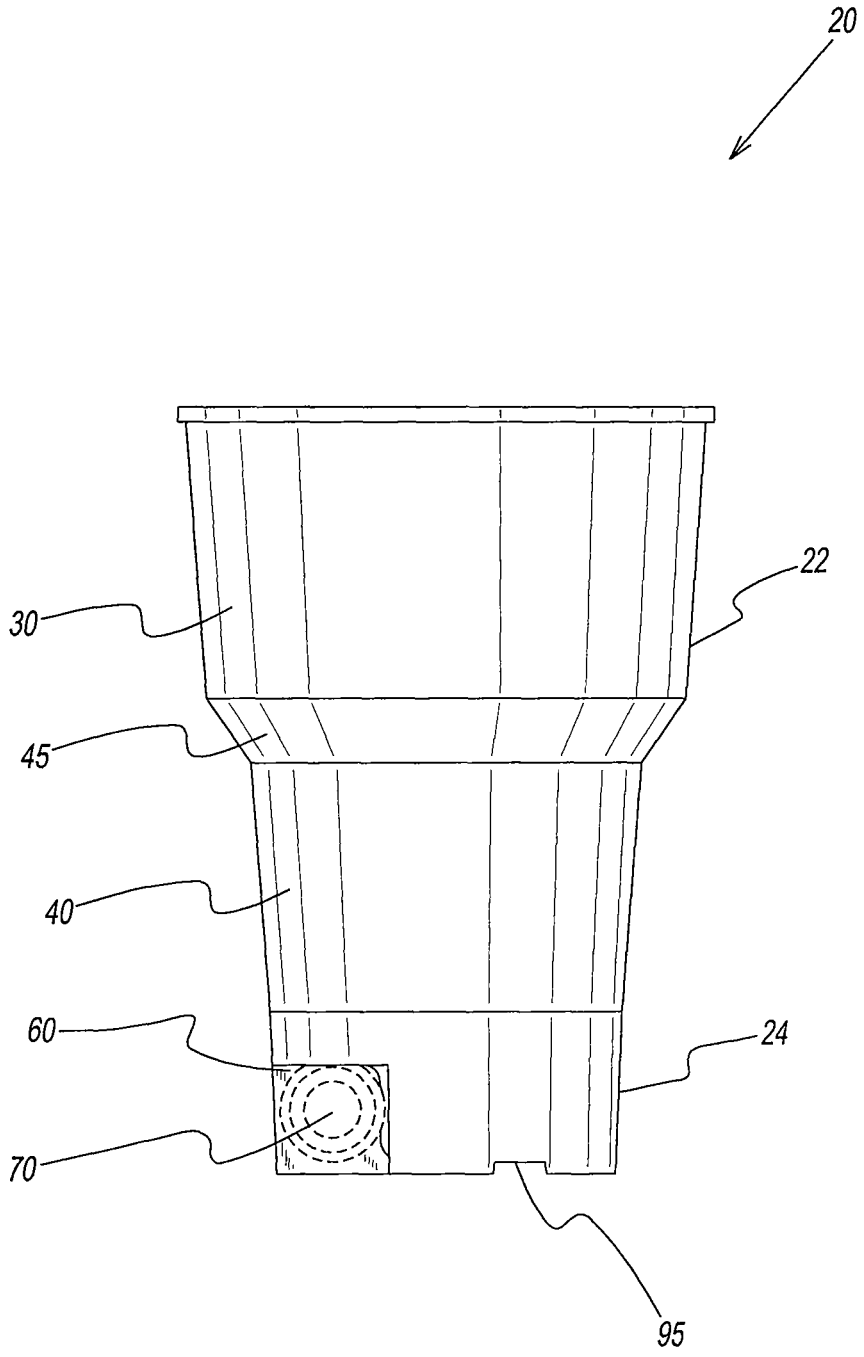
FIG. 10 is a first side view of the vessel of FIG. 8.
Figure 11:
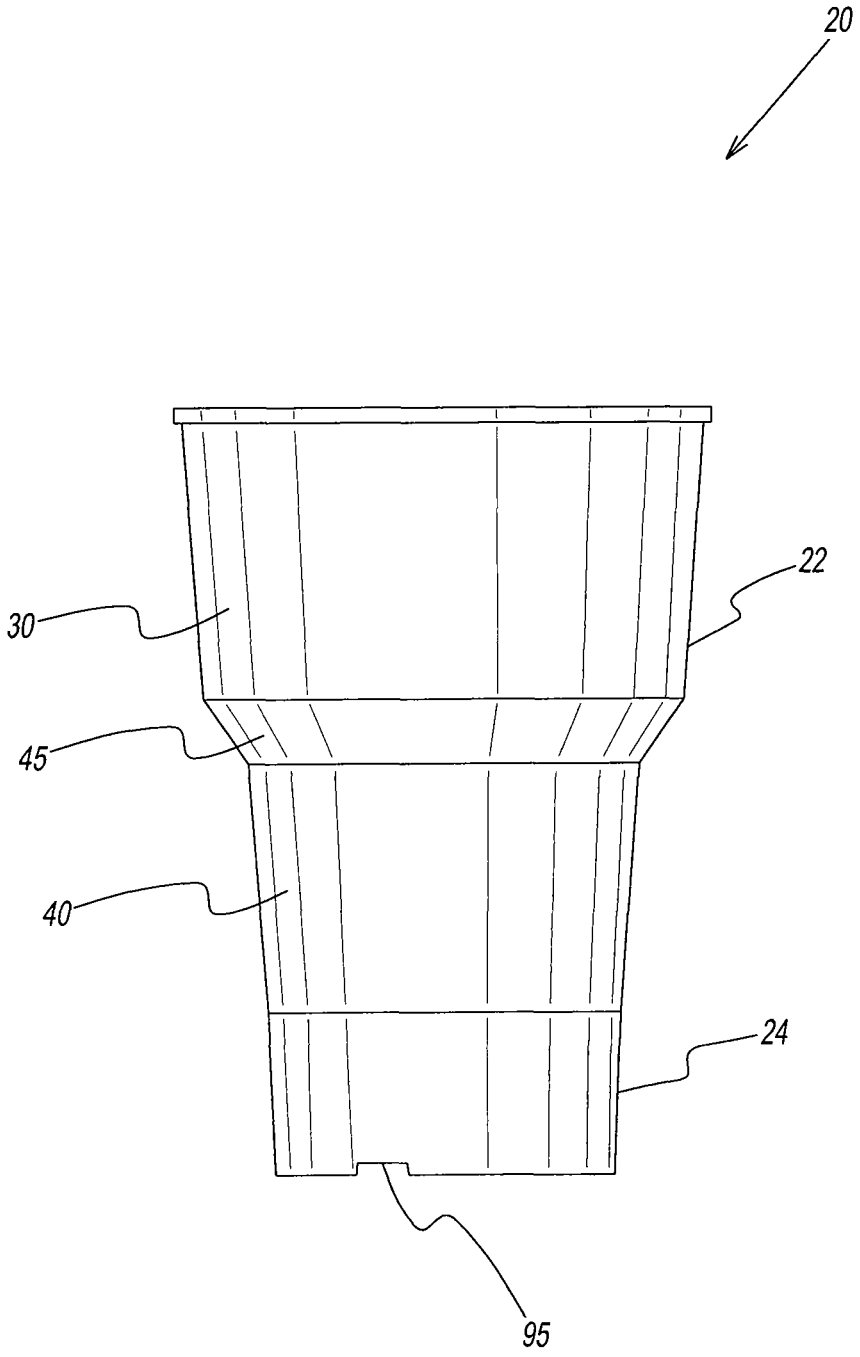
FIG. 11 is a second side view of the vessel of FIG. 8.
Figure 12:
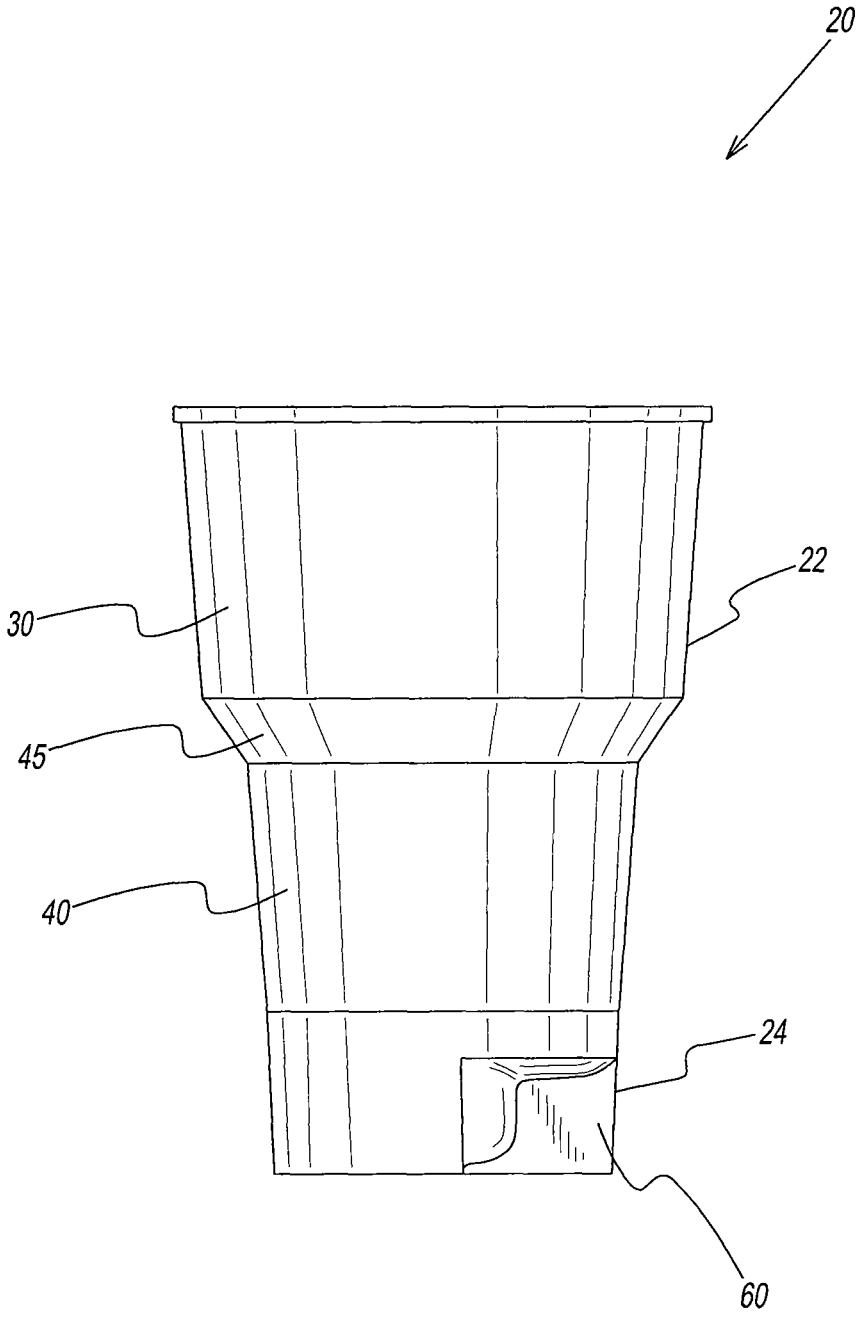
FIG. 12 is a third side view of the vessel of FIG. 8.

As described above, cup portion 22 may contain a middle portion 45 which acts as a transition area, as shown in FIG. 10. When the liquid, flowing in a tight vortex stream, reaches the level of middle portion 45, it causes the upper section of the vortex to become shallow and settle. Thereafter, the liquid fills to the top of vessel 20 with a decreased chance of over spill. The design of base portion 24 provides for a rapid fill with minimal fobbing and foaming. Middle portion 45 can also act as a grip, allowing the user to more easily handle vessel 20.

Dispenser 30 may have one or more controllers on housing 32 for regulating dispense system 10. Dispenser 30 can have any number of controllers required, In one embodiment, dispenser 30 has a first controller 110 which may be a vessel detection switch (limit switch) to detect vessel 20. First controller 110 may be located within holding area 42. Preferably, first controller 110 is located on the rear of inner wall 46, as shown in FIGS. 2-4.

Dispenser 30 may have a second controller 115 that may be a momentary contact switch (cancel button) that functions to cancel the flow of liquid to nozzle 75. Second controller 115 may be located on upper panel 38. Preferably, second controller 115 is raised above the surface upper panel 38, to be easily accessed by a user, as shown in FIGS. 2 and 4-5.

Dispenser 30 may have a third controller 120 that may be a momentary contact switch (start dispense/"top off" button) that functions to allow a user to "top off" vessel 20 with liquid if the amount of liquid dispensed was incorrect or there was spillage, or manually dispense a liquid. Preferably, third controller 120 is located below the surface of upper panel 38, to be less accessible to user and prevent an accidental activation, as shown in FIGS. 2 and 3.

Dispenser 30 may have any number of indicators to alert the user to various events. Preferably, dispensing system 10 has an indicator 122 to alert the user whether dispensing system 10 is ready or not ready to dispense liquid. Preferably indicator 122 is located on an area of housing 32 that is easily visible or audible to a user. Any type of indicator can be uses such as light, sound, color, etc. Preferably, indicator 122 is an LED indicator light, as shown in FIGS. 2 and 3, that displays green when ready to dispense and red when not ready to dispense liquid.

Figure 20:
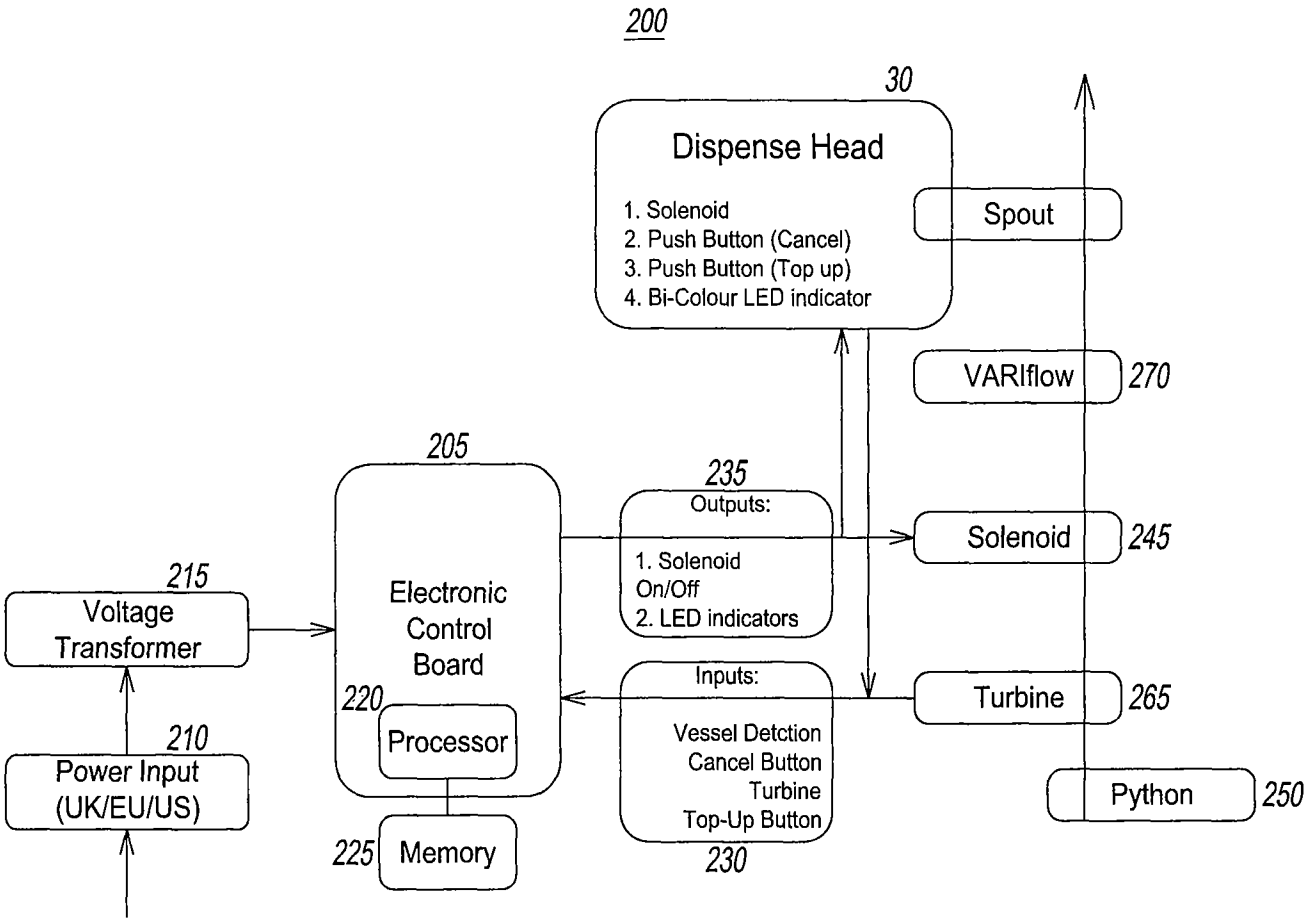
FIG. 20 is a block diagram of a control system of the dispensing system of the present disclosure.

Dispensing system 10 contains a control system 200, for the employment of the present invention. Control system 200 is shown in the bock diagram of FIG. 20 and FIGS. 28 and 29. Components of control system 200 are interconnected through a control board 205 requiring a power input 210 via a voltage transformer 215. Preferably, power input 210 provides between about 100 volts AC and 240 volts AC.

Control board 205 contains a processor 220 and is communication with a memory 225. Processor 220 is configured of logic circuitry that is in communication with control board 205 and responds to at least one input 230 and executes at least one output 235. Control board 205 contains at least one terminal where inputs 230 and outputs 235 connect thereto. Processor 220 can be programmed to several different configurations. Furthermore, processor 220 can be removable and replaceable in the event of damage or a failure.

Memory 225 stores data and instructions related to at least one input 230 and at least one output 235 for controlling processor 220. Preferably, control system 200 contains a plurality of inputs 230 and a plurality of outputs 235. Control system 200 may have primary components, such as, but not limited to, first controller 110 functioning as a vessel detection switch (limit switch), a solenoid 245 functioning as a dispense start/stop device, a turbine 265 functioning as a flow measuring apparatus, second controller 115 functioning as a momentary contact switch (cancel button), third controller 150 functioning as a momentary contact switch (start dispense/top off button) and status indicator 122, which is preferably an LED indicator.

As described above, dispenser 30 may contain first controller 110 for the detection of vessel 20. First controller 110 is activated once vessel 20 is fully secured in holding area 42. Upon activation, an input signal is sent from first controller 110 to control board 205 indicating that vessel 20 is detected in holding area 24 and is ready to receive liquid via nozzle 75.

Furthermore, upon detection of vessel 20, control system 200 can be programmed to automatically begin dispensing liquid upon activation of first controller 110. Thereafter, solenoid 245 that is located within a python 250 receives an output signal from control board 205. The output signal causes solenoid 245 to become energized and lift a plunger to be removed from the flow path of the liquid and commence dispensing into vessel 20 via nozzle 75. Solenoid 245 will remain energized until control board 205 stops the output signal. This occurs when control board 205 has determined the required volume of liquid has been dispensed into vessel 20.

Turbine 265, which is in the direct flow of the liquid, is located on python 250 and used to determine when the required volume of liquid has been dispensed, thereby ensuring a perfect volumetric fill every time. As liquid passes through turbine 265 it causes turbine 265 to rotate. Magnets (not shown) within the vanes of turbine 265 will pass over a receiver point (not shown). As a result, pulsing signals are generated, and then received and counted by control board 205. The number of pulsing signals counted by electronic control board 205 is directly correlated with the volume of liquid that is passing through turbine 265. Thus, the number of pulsing signals directly corresponds to the volume of liquid dispensed into vessel 20.

As described above, dispenser 30 may contain second controller 115 to cancel the dispensing of a liquid. Second controller 115 is utilized by the user if dispensing system 10 is activated incorrectly or needs to be shut down. If second controller 115 is activated, an input signal is sent to control board 205 to stop solenoid 245 immediately. This input signal will override all other input signals.

Furthermore, as previously described, dispenser 30 may contain a third controller 120 to manually start dispensing. Activation of third controller 120 sends an input signal to control board 205 to allow the user to manually dispense liquid into vessel 20. This can be used to "top off" a vessel 20 after dispensing or to manually begin dispensing a liquid when first controller 110 is only used for vessel detection.

Indicator 122 notifies a user whether dispenser system 10 is ready or not ready for dispensing. Indicator 122 may be an LED indicator light that receives an output signal from control board 205. Indicator 122 indicates green when the dispensing system 10 is ready and red when dispensing system 10 is not ready.

Below provides the operation logic of dispensing system 10:

Operation Logic (Automatic)

1. Dispensing system 10 power on
2. Indicator 122 LED—Red="No Vessel 20 Detected"
3. Vessel 20 detected—micro switch contact made—inputs to control board 205
4. Indicator 122 LED—Green="Dispensing"/solenoid 245 energized (Dispensing Starts)
5. Flowmeter 270 counts input until volume is reached
6. Indicator 122 LED—Red="Ready/No Vessel 20"/solenoid 245 de-energized (Dispensing Stops)
   Second controller 115 to cancel input: Can be activated at any stage during the dispensing, which instantly de-energizes solenoid 245 to stop dispensing (and resets the internal counter for flowmeter 270)

Operation Logic (Semi-Automatic)

1. Dispensing system 10 power on
2. Indicator 122 LED—Red="No Vessel 20 Detected"
3. Vessel 20 detected—micro switch contact made—inputs to control board 205
4. Indicator 122 LED—Green="Ready"
5. Third controller 120 pressed to start dispense—inputs to control board 205
6. Indicator 122 LED "Dispensing"/solenoid 245 energized (Dispensing Starts)
7. Flowmeter 270 counts Input until the preset count is reached The preset count correlates directly to the volume required (½ Pint, Pint, 500 ml, 16 fl oz)
8. Indicator 122 LED "Dispense Complete-Remove Vessel 20"/solenoid 245 de-energized (Dispensing Stops)
9. Indicator 122 LED—Red="No Vessel 20 Detected"
   Second controller 115 to cancel input: Can be activated at any stage during the dispense, which instantly de-energizes solenoid 245 to stop dispensing (and resets the internal counter for flowmeter 270)

Figure 21:
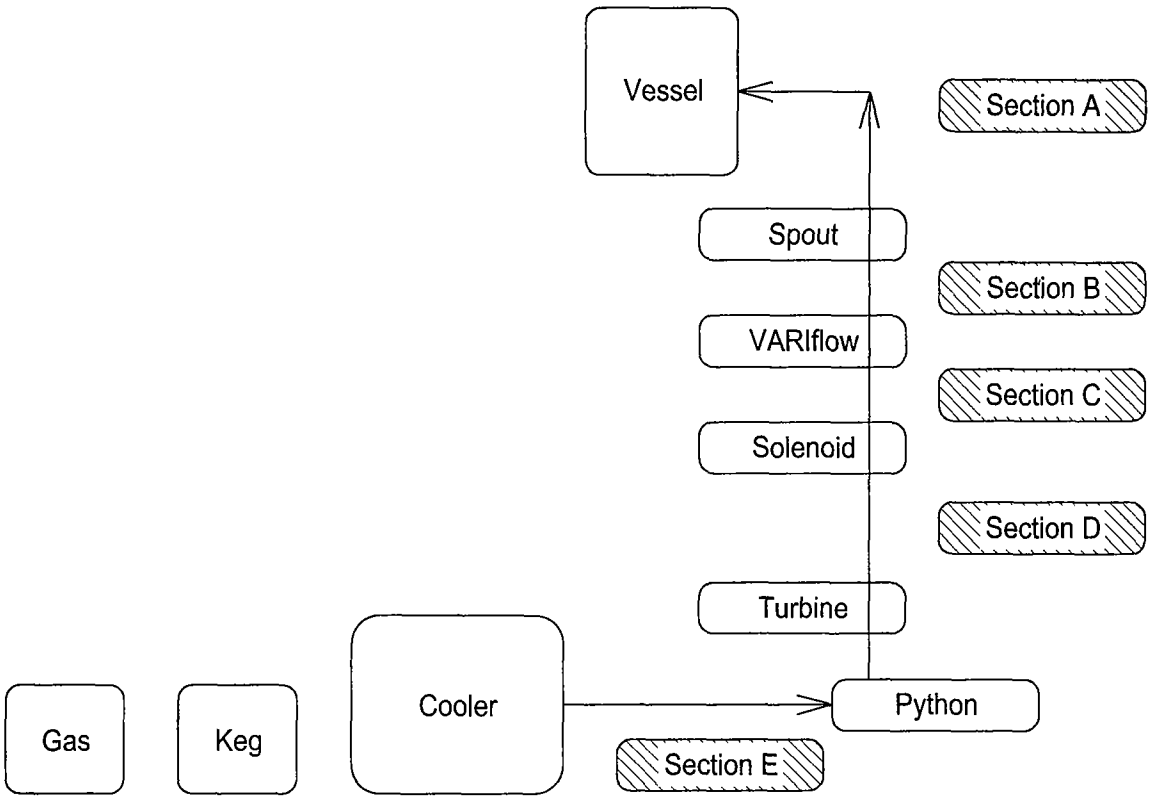
FIG. 21 is a block diagram of a system of the dispensing system of the present disclosure.

In summary, control system 200 utilizes to deliver the liquid or product into vessel 20 at the expected quality. Most of the primary components are located outside the flow of liquid, except for solenoid 245, turbine 265 and flowmeter 270. FIG. 21 shows another system of the present disclosure.

In addition to the primary components described above, control board 205 can have any number of secondary components from other devices which are not essential to the function of dispensing system 10. This includes, but is not limited to, an electronic FOB, a temperature probe, a pressure gauge or other similar devices.

Control board 205 can receive an input signal from an electronic FOB which is usually located at the source of the liquid or product supply to be dispensed. This input signal may indicate to control system 200 that the supply, such as a keg or other beverage container, is now empty. In response, control system 200 will shut down so that there is no pressure drip and, thus, no wasting of product. Furthermore, it will indicate to the user that the product needs to be replenished, e.g., by a visual or audio alert.

Control board 205 may also receive an input signal from a temperature probe measuring the temperature of the liquid or product to be dispensed. Control system 200 can be set with temperature parameters, such that if the product temperature is out of the specified range, control system 200 will shut down. This allows a user to guarantee product quality of the dispensed liquid.

Furthermore, control board 205 may receive an input signal from a pressure gauge that measures the pressure used to dispense a liquid. Control system 200 can be set with pressure parameters, such that if the pressure used to dispense the liquid is out of the specified range, control system 200 will shut down. This indicates to a user that the pressure source needs to be replaced.

Control board 205 may have a hard wire connection port so that a laptop, PC or other device can be connected thereto. Furthermore, control board 205 may be connected to a touch screen and/or Ethernet connection. These can provide real time information and be used to control or modify settings, such as, but not limited to, the volume of liquid dispensed or other settings. It is preferred that the volume of liquid dispensed is pre-set in the factory for the market requirements, for example, 1 pint for UK, ½ liter for EU and 16 fluid ounces for the US.

To use dispensing system 10, a user will turn the power on and face front end 34 of dispenser 30, having outlet end 85 of nozzle 75 facing them. The user will have a vessel 20 in one hand or a vessel 20 in each hand, depending on whether there is a plurality of dispensers 30. At this point, the LED indicator of indicator 122 has a red status since there is no vessel in dispenser 30.

The user will then place vessel 20 at receiving area 48 of holding area 42 with depression 60 facing protuberance 65. The user will align ridge 90 on floor 44 with recess 95 on vessel 20. Then, the user will slide vessel 20 along floor 44 until valve 72 on aperture 70 is fully engaged with nozzle 75. First controller 110 then detects vessel 20 and dispensing system 10 either: 1.) begins dispensing liquid immediately and the user uses third controller 120 to "top off" if necessary, or 2.) allows the user to manually begin dispensing a liquid using third controller 120 to fill vessel 20.

As a safety feature, a liquid will not dispense unless first controller 110 detects a vessel 20. At anytime the user may manually stop the flow of liquid using second controller 115. Once vessel 20 is full, the user removes vessel 20 by sliding off holding area 42.

In use, dispensing system 10 can dispense a liquid into vessel 20 in about 3 to 13 seconds per pint, and preferably in about 4 to 7 seconds per pint. Dispensing system can dispense at any temperature depending on the type of liquid. Preferably, the liquid is at a temperature of about 0 to 4 degrees Celsius, and more preferably, at about 0 to 2 degrees Celsius. Furthermore, the head foam height for a liquid dispensed into vessel 20 can be adjusted according to the user's specification.

Figure 27:
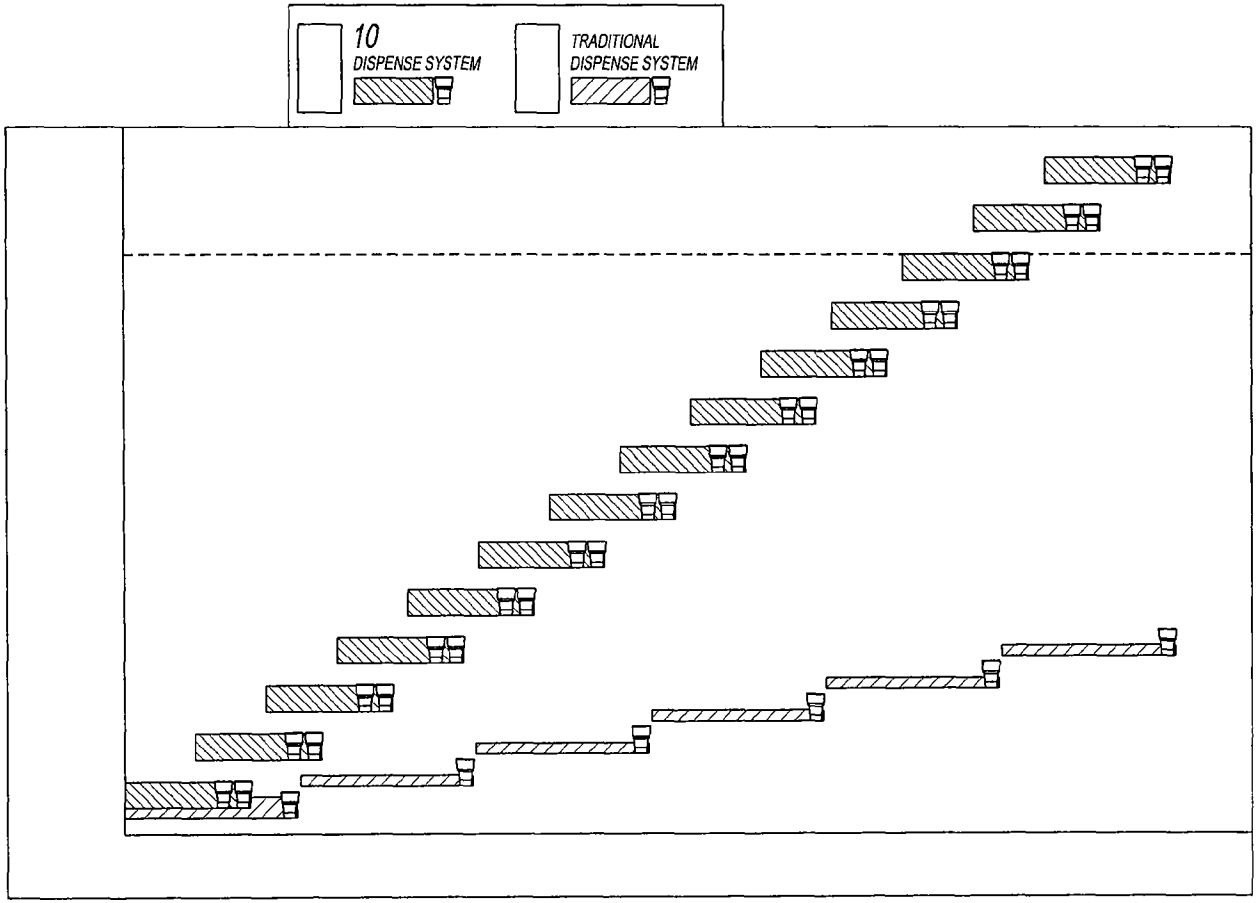
FIG. 27 is a chart showing the increased speed of the dispensing system of the present disclosure compared to a traditional system.

Dispensing system 10 is designed to be connected to an existing or traditional beverage system and can be set to dispense at traditional speeds if required by the user. For example, a traditional system has a dispense speed of about 14-16 seconds and a product temperature at point of dispense of 4 degrees Celsius on a beverage, such as a lager product, with a gas content of 2.2 volumes CO2 with a CO2 top pressure of 32 PSI. FIG. 27 shows the increase in fill speed of dispensing system 10 compared to traditional dispensing systems Since dispenser 30 is designed to easily load and unload a vessel 20, a user can remove a full vessel 20 and replace with an empty vessel 20 rapidly, thereby substantially increasing product sales and speed of distribution to the consumer. Preferably, a user can remove and replace a vessel in about 3 seconds.

Figure 25:
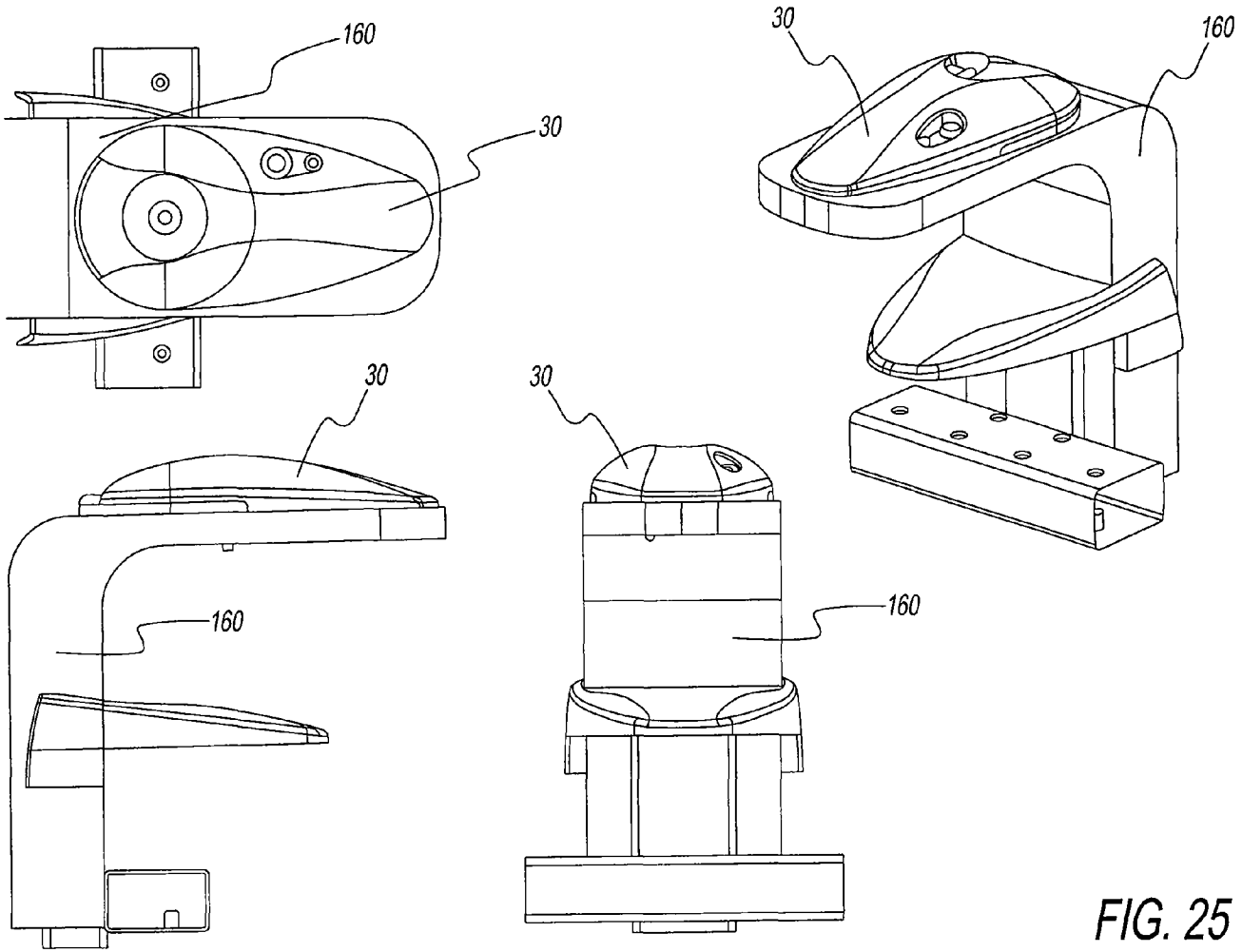
FIG. 25 shows a dispenser on a bracket of the present disclosure.

Dispensing system 10 can be used with a single dispenser 30 or contain a plurality of dispensers 30 to allow for multiple fills at the same time. In addition, dispenser 30 may be attached to a bracket 160, as shown in FIG. 25, which can be attached to any ledge, such as a bar. Bracket 160 allows dispensing system 10 to be more easily viewed by those at the venue while a liquid is dispensing into vessel 20.

Figure 22:
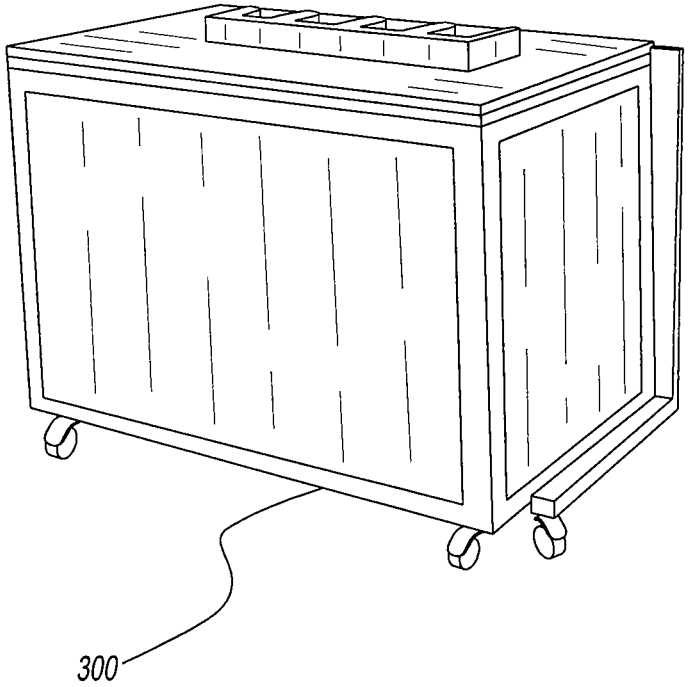
FIG. 22 is a perspective view of a unit of the present disclosure.
Figure 23:
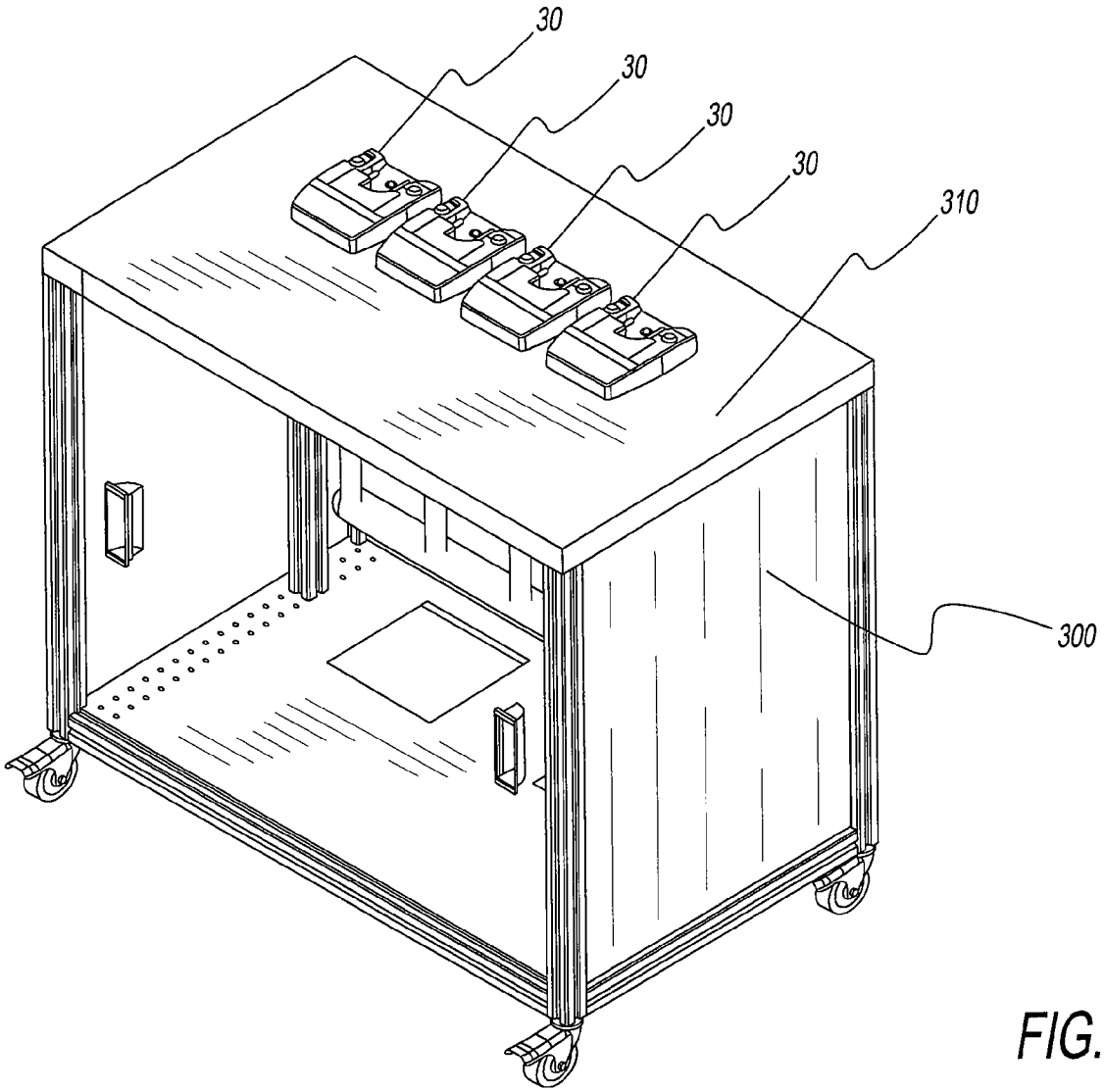
FIG. 23 is a perspective view of a unit of the present disclosure.
Figure 24:
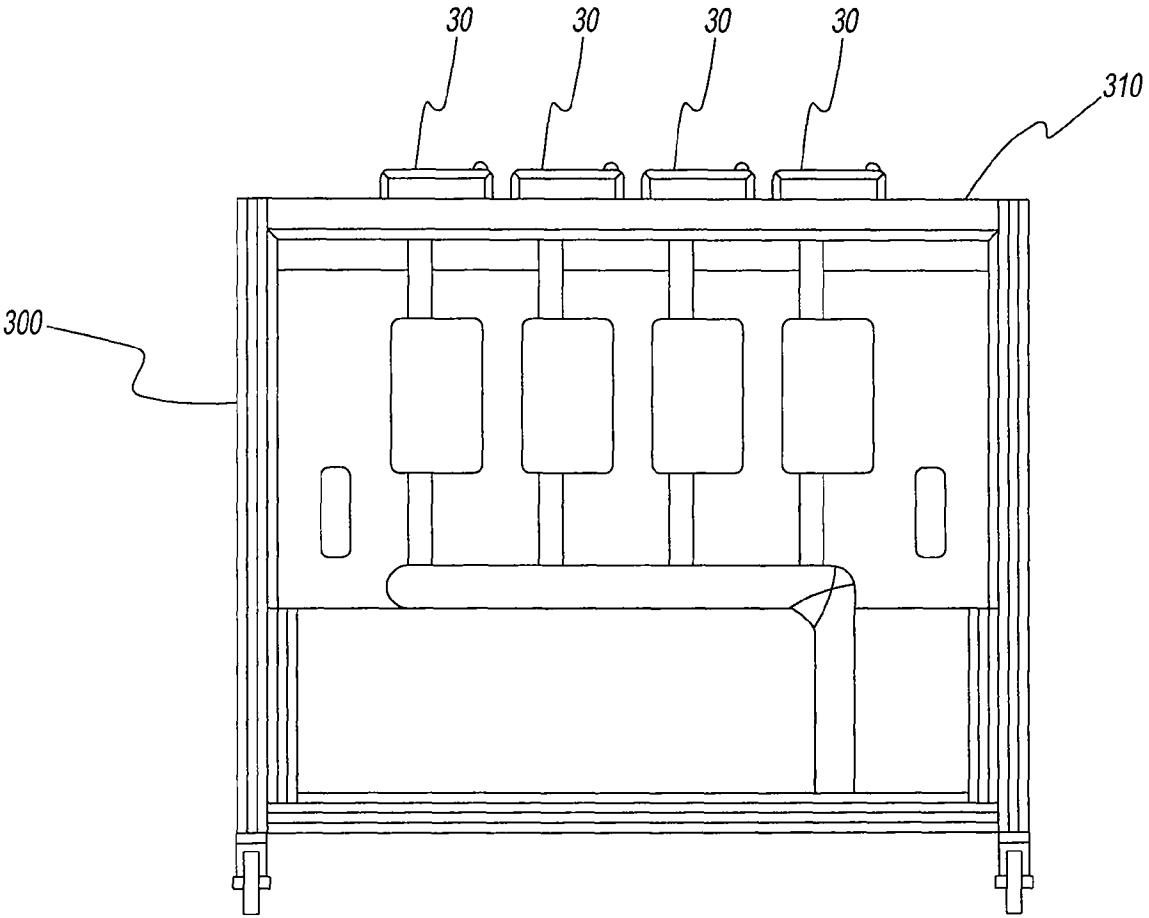
FIG. 24 is a side view of a mobile unit of the present disclosure.

Furthermore, dispensing system 10 can be on a unit 300 as shown in FIGS. 22-24. It is preferred that unit 300 is mobile and utilizes swivel wheels having brakes, however any mechanism for mobility can be used. This allows dispensing system 10 to be easily positioned at any selected venue. At the venue, dispenser 30 can be connected to a main python system and power supply and then commence dispensing. All connections on unit 300 are ergonomically designed and located in easy access positions to connect with dispenser 30, as shown in FIG. 24. Unit 300 is designed to be positioned against a wall or alongside another unit 300 to create a row of units 300.

Each unit 300 can contain any number of dispensers 30 on top surface 310. Preferably, unit 300 has four dispensers 30. It is preferred that unit 300 is symmetrical so that dispenser 30 may be able to rotate so that liquid can be dispensed from either side. Top surface 310 may be a rest for vessel 20 and provide for drainage into a container within unit 300. Top surface 310 can be made of any material, such as, stainless steel or other similar material. Furthermore, all components within unit 300 are fully sealed to ensure that there is no damage during use or during cleaning after use.

Figure 26:
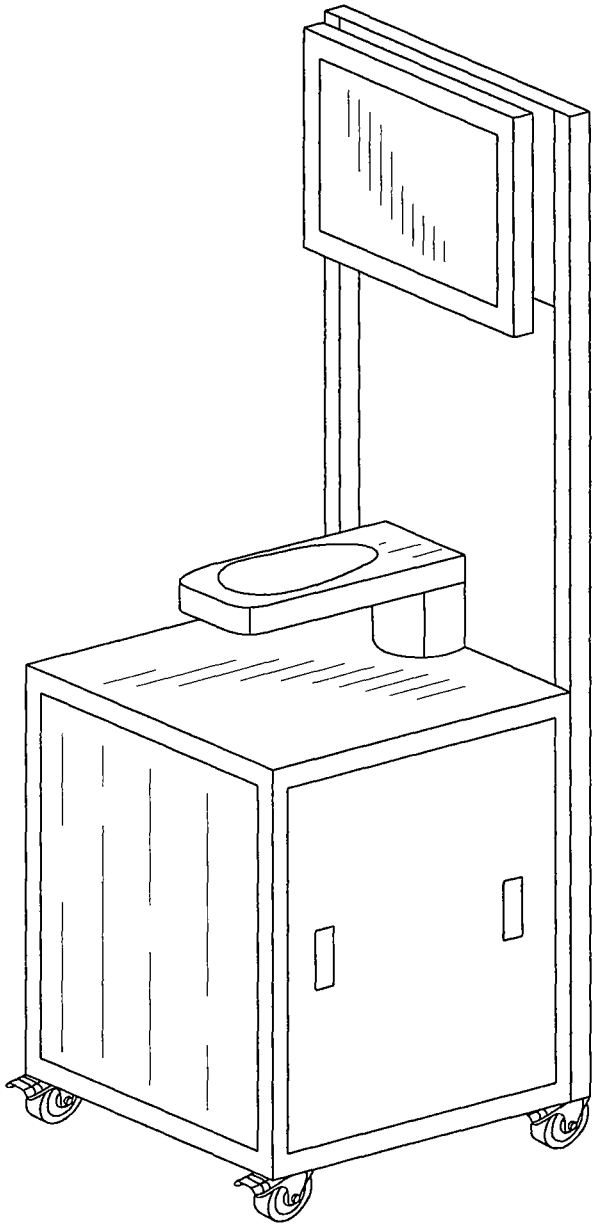
FIG. 26 is a perspective view of a unit having a monitor of the present disclosure.

Unit 300 can be made out of any material, such as, but not limited to, metal, plastic, wood, and the like. Preferably, unit 300 is made of an aluminum extrusion and clad with sheet metal. It is contemplated that a user may display any branding information on any surface of unit 300, which is removable after use. In addition, unit 300 can be adapted to include a screen or monitor overhead, as shown in FIG. 26. All components within unit 300 may be traced cooled.

What is claimed is:

1. A beverage dispensing system comprising:

a dispenser assembly which comprises a housing, said housing having a first end, a second end, an upper panel and a lower panel, a dispenser base portion disposed within said housing, said dispenser base portion comprising a bottom surface and a wall disposed upwardly from said bottom surface, wherein said wall is discontinuous so as to provide an opening through said first end, a first alignment mechanism, and a beverage dispensing nozzle, said beverage dispensing nozzle affixed to said first alignment mechanism; and a vessel which comprises a vessel base portion and a vessel upper portion, wherein said vessel base portion comprises a first receiver configured to receive said first alignment mechanism, and an aperture disposed in said first receiver, wherein said first alignment mechanism causes the alignment of said beverage dispensing nozzle with said aperture disposed in said vessel base portion and seating of said vessel within said dispenser base portion, and wherein the configuration of said first receiver and said first alignment mechanism provide for the alignment of said beverage dispensing nozzle with said aperture disposed in said vessel base portion and the seating of said vessel within said dispenser base portion in a substantially straight line linear direction.

2. The beverage dispensing system according to claim 1, further comprising at least one second alignment mechanism disposed on said bottom surface of said dispenser base portion, and a second receiver disposed about an exterior bottom surface of said vessel base portion for receiving said second alignment mechanism to further assist in the alignment of said vessel within said dispenser assembly.

3. The beverage dispensing system according to claim 2, wherein said second alignment mechanism is a ridge portion disposed on said bottom surface of said base portion so as to receive said second receiver of said vessel.

4. The beverage dispensing system according to claim 1, further comprising a sensor for detecting the presence of said vessel, wherein the detecting provides for allowing beverage to flow from said beverage dispensing nozzle into said vessel.

5. The beverage dispensing system according to claim 1, wherein said first alignment mechanism is disposed about said nozzle and wherein said first recessed portion is formed about said aperture, wherein when said first alignment mechanism is properly seated within said first recessed portion, said nozzle enters said aperture.

6. The beverage dispensing system according to claim 5, wherein said aperture includes a valve which allows for said nozzle to penetrate into an interior volume of said vessel and, upon activation of said dispenser, beverage passes from said nozzle into the interior volume of said vessel.

7. The beverage dispensing system according to claim 6, wherein said valve is a one-way valve or a non-return valve.

8. The beverage dispensing system according to claim 1, wherein said vessel further comprises an upwardly sloped incline radially disposed about the interior of said vessel base portion, such that said beverage entering said vessel via said aperture travels substantially up said ramp, such that said beverage passes over said aperture upon traversing approximately 360 degrees around the circumference of the interior of said vessel.

9. The beverage dispensing system according to claim 4, further comprising a controller which activates a pump to distribute said beverage to said nozzle and into said interior volume and deactivates said pump when a predetermined quantity of beverage has been received by said vessel.

10. The beverage dispensing system according to claim 1, wherein said first recessed portion is a shape substantially similar to said first alignment mechanism so as to permit a substantially female to male connection therebetween.

11. The beverage dispensing system according to claim 10, wherein said shape is selected from the group consisting of: a rectangle, a square and cylindrical.

12. The beverage dispensing system according to claim 1, wherein the alignment of said beverage dispensing nozzle with said aperture includes insertion of said beverage dispensing nozzle into said aperture, and wherein the insertion of said beverage dispensing nozzle into said aperture and the seating of said vessel within said dispenser base portion occur substantially simultaneously.

13. The beverage dispensing system according to claim 12, wherein the beginning of insertion of said beverage dispensing nozzle into said aperture occurs prior to the complete seating of said vessel within said dispenser base portion.

14. A beverage dispenser assembly comprising:

a housing, said housing having a first end, a second end, an upper panel and a lower panel;

a base portion disposed within said housing, said base portion comprising a bottom surface and a wall disposed upwardly from said bottom surface, wherein said wall is discontinuous so as to provide an opening through said first end;

a beverage dispensing nozzle; and at least a first alignment mechanism disposed within said base portion having said beverage dispensing nozzle affixed thereto to cause alignment of said beverage dispensing nozzle with a vessel to be filled with a beverage, and wherein the configuration of said first receiver and said first alignment mechanism provide for the alignment of said beverage dispensing nozzle with said aperture disposed in said vessel base portion and the seating of said vessel within said dispenser base portion in a substantially straight line linear direction.

15. The beverage dispenser assembly according to claim 14, wherein said base portion includes a second alignment mechanism comprising at least one selected from the group consisting of: a ridge portion disposed on said bottom surface of said base portion and a perturbation extending from said side wall of said base portion and said vessel includes a receiving portion for receiving said ridge or said perturbation.

16. The beverage dispenser assembly according to claim 14, further comprising a sensor for detecting the presence of said vessel, wherein the detecting provides for allowing beverage to flow from said beverage dispensing nozzle into said vessel.

17. The beverage dispenser assembly according to claim 16, further comprising a controller which activates a pump to distribute said beverage to said nozzle and deactivates said pump when a predetermined quantity of said beverage has passed through said nozzle.

18. The beverage dispenser assembly according to claim 15, wherein said perturbation extending from said bottom surface or said side wall has a shape selected from the group consisting of: a rectangle, a square and cylindrical.

19. A vessel comprising:

a base portion comprising a base wall; and an upper portion, wherein said base portion comprises: a first receiver disposed in said base wall of said vessel base portion and configured to receive a first dispenser alignment mechanism, a second receiver disposed in said base wall of said vessel base portion for receiving a second dispenser alignment mechanism, and an aperture disposed in said first receiver to receive a nozzle, and wherein the configuration of said first and second receivers and said first and second alignment mechanisms provide for the alignment of said beverage dispensing nozzle with said aperture disposed in said vessel base portion and the seating of said vessel within said dispenser base portion in a substantially straight line linear direction.

20. The vessel according to claim 19, wherein said aperture includes a valve, and wherein said valve is a one-way valve or a non-return valve.

21. The vessel according to claim 19, wherein said vessel further comprises an upwardly sloped incline radially disposed about an interior of said vessel base portion, such that said beverage entering said vessel via said aperture will travel substantially up said ramp, and such that said beverage passes over said aperture upon traversing approximately 360 degrees around a circumference of the interior of said vessel.

22. A method for dispensing a beverage into a vessel comprising:

activating a beverage dispenser assembly comprising a housing, said housing having a first end, a second end, an upper panel and a lower panel;

a dispenser base portion disposed within said housing, said dispenser base portion comprising a bottom surface and a wall disposed upwardly from said bottom surface, wherein said wall is discontinuous so as to provide an opening through said first end, a first alignment mechanism, a power source and a beverage dispensing nozzle affixed to said first alignment mechanism;

placing a vessel comprising a vessel base portion and a vessel upper portion on to said dispenser base portion, wherein said vessel base portion comprises a first receiver and an aperture disposed in said first receiver;

aligning said first receiver of said vessel with said first alignment mechanism of said dispenser assembly, wherein the aligning causes the alignment of said beverage dispensing nozzle with said aperture disposed in said vessel base portion and seating of said vessel within said dispenser base portion, and wherein the alignment is obtained by relative movement between said beverage dispensing nozzle and said aperture in a substantially straight line linear direction.

23. The method according to claim 22, further comprising at least one second alignment mechanism disposed on said wall or said bottom surface of said dispenser base portion and a second receiver disposed about an exterior surface of said vessel base portion for receiving said second alignment mechanism to further assist in the alignment of said vessel within said dispenser assembly.

24. The method according to claim 23, wherein said second alignment mechanism is a ridge portion disposed on said bottom of said base portion so as to receive said second receiver of said vessel, thereby insuring that said beverage dispensing nozzle aligns with and is received by said aperture of said vessel.

25. The method according to claim 22, further comprising detecting the presence of said vessel in said dispenser base portion and seating of said nozzle within said aperture; and passing a beverage from said beverage dispensing nozzle into said vessel.

26. The method according to claim 22, wherein said aperture includes a valve which allows for said nozzle to penetrate into an interior of said vessel about said vessel base portion and, after activation of said dispenser, beverage passes from said nozzle into the interior of said vessel.

27. The method according to claim 26, wherein said valve is a one-way valve or a non-return valve.

28. The method according to claim 22, wherein said vessel further comprises an upwardly sloped incline radially disposed about an interior of said vessel base portion, such that said beverage entering said vessel via said aperture travels substantially up said ramp, such that said beverage passes over said aperture upon traversing approximately 360 degrees around the circumference of the interior of said vessel.

29. The method according to claim 25, further comprising receiving a signal from said detecting step which, in turn, activates a pump to distribute said beverage to said nozzle and into the interior of said vessel and deactivates said pump when a predetermined quantity of beverage has been received by said vessel.

30. The method according to claim 22, wherein the aligning of said beverage dispensing nozzle with said aperture includes insertion of said beverage dispensing nozzle into said aperture, and wherein the insertion of said beverage dispensing nozzle into said aperture and the seating of said vessel within said dispenser base portion occur substantially simultaneously.

31. The beverage dispensing system according to claim 30, wherein the beginning of insertion of said beverage dispensing nozzle into said aperture occurs prior to the complete seating of said vessel within said dispenser base portion.

* * * * *